US011584125B2

(12) United States Patent
Nodsu et al.

(10) Patent No.: US 11,584,125 B2
(45) Date of Patent: Feb. 21, 2023

(54) LIQUID DISCHARGE APPARATUS, LIQUID DISCHARGE METHOD AND NON TRANSITORY COMPUTER-READABLE MEDIUM STORING CONTROL PROGRAM FOR LIQUID DISCHARGE APPARATUS

(71) Applicant: Brother Kogyo Kabushiki Kaisha, Nagoya (JP)

(72) Inventors: Tomohiro Nodsu, Seto (JP); Yuichi Ito, Mie-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 36 days.

(21) Appl. No.: 16/941,739

(22) Filed: Jul. 29, 2020

(65) Prior Publication Data

US 2021/0031511 A1 Feb. 4, 2021

(30) Foreign Application Priority Data

Jul. 29, 2019 (JP) ..... JP2019-139079

(51) Int. Cl.
*B41J 2/045* (2006.01)
*B41J 2/18* (2006.01)

(52) U.S. Cl.
CPC ..... *B41J 2/04596* (2013.01); *B41J 2/04581* (2013.01); *B41J 2/04588* (2013.01); *B41J 2/04595* (2013.01); *B41J 2/18* (2013.01); *B41J 2202/12* (2013.01); *B41J 2202/20* (2013.01)

(58) Field of Classification Search
CPC ..... B41J 2/04596
See application file for complete search history.

(56) References Cited

U.S. PATENT DOCUMENTS 7,819,491 B2 10/2010 Nishimura
2008/0117245 A1 5/2008 Nishimura
2011/0026058 A1* 2/2011 Rosati ..... B41J 11/007 358/1.9
2011/0205273 A1* 8/2011 Hibino ..... B41J 2/155 347/10
2011/0234671 A1* 9/2011 Suzuki ..... B41J 2/16526 347/14
2013/0106929 A1* 5/2013 Tanaka ..... B41J 2/175 347/6

FOREIGN PATENT DOCUMENTS

JP 2008-126535 A 6/2008
JP 2012-140003 A 7/2012

* cited by examiner

*Primary Examiner* — Shelby L Fidler
(74) *Attorney, Agent, or Firm* — Banner & Witcoff, Ltd.

(57) ABSTRACT

There is provided a liquid discharge apparatus including: a conveyer; head chips; a circulation channel; and a controller. Each head chip includes a manifold; a nozzle group, and actuators. Each head chip is configured to execute discharge drive and non-discharge vibration drive. The head chips include: an end head chip; a facing head chip facing the recording medium; and a non-facing head chip not facing the recording medium. The controller is configured to make at least one of a circulation flowing amount of a liquid in the circulation channel in the facing head chip and a frequency of the non-discharge vibration drive by an actuator included in the actuators in the facing head chip larger than those of the non-facing head chip.

9 Claims, 17 Drawing Sheets

| HEAD CHIP | | NON-FACING HEAD CHIP | | | END HEAD CHIP | | | FACING HEAD CHIP | | | | | | END HEAD CHIP | | | NON-FACING HEAD CHIP | | |
|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 |
| FREQUENCY LEVEL | HIGH DUTY | 1 | 1 | 1 | 3 | 4 | 4 | 2 | 2 | 2 | 2 | 2 | 2 | 4 | 4 | 3 | 1 | 1 | 1 |
| | LOW DUTY | 1 | 1 | 1 | 3 | 5 | 5 | 3 | 3 | 3 | 3 | 3 | 3 | 5 | 5 | 3 | 1 | 1 | 1 |
| FLOWING AMOUNT LEVEL | | 1 | 1 | 1 | 3 | 3 | 3 | 2 | 2 | 2 | 2 | 2 | 2 | 3 | 3 | 3 | 1 | 1 | 1 |

Fig. 3
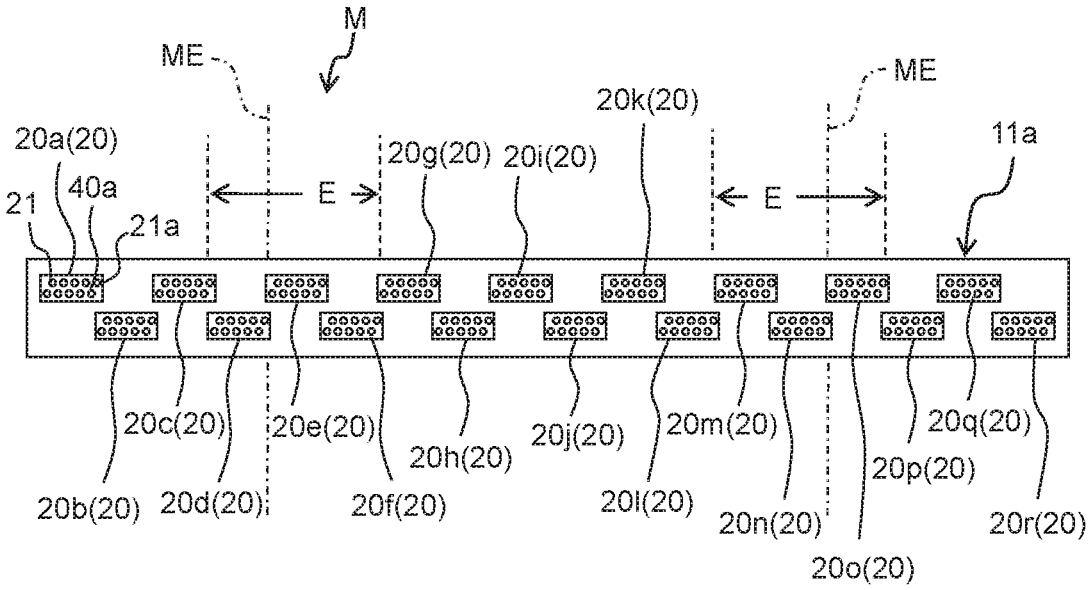
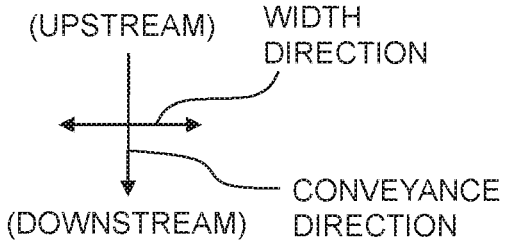

Fig. 6A

ACTUATOR

| DRIVE CYCLE | 1 | 2 | 3 | 4 | 5 | 6 | 7 | 8 | 9 | 10 | 11 |
|---|---|---|---|---|---|---|---|---|---|---|---|
| 1 | 0 | 0 | 0 | 0 | 0 | 0 | 0 | 0 | 0 | 0 | 0 |
| 2 | 0 | 2 | 2 | 0 | 0 | 0 | 0 | 0 | 2 | 2 | 0 |
| 3 | 0 | 2 | 2 | 0 | 0 | 0 | 0 | 0 | 2 | 2 | 0 |
| 4 | 0 | 0 | 3 | 3 | 0 | 0 | 0 | 3 | 3 | 0 | 0 |
| 5 | 0 | 0 | 3 | 3 | 0 | 0 | 0 | 3 | 3 | 0 | 0 |
| 6 | 0 | 0 | 0 | 3 | 3 | 0 | 3 | 3 | 0 | 0 | 0 |
| 7 | 0 | 0 | 0 | 3 | 3 | 0 | 3 | 3 | 0 | 0 | 0 |
| 8 | 0 | 0 | 0 | 0 | 4 | 4 | 4 | 0 | 0 | 0 | 0 |
| 9 | 0 | 0 | 0 | 0 | 4 | 4 | 4 | 0 | 0 | 0 | 0 |
| 10 | 0 | 0 | 0 | 3 | 3 | 0 | 3 | 3 | 0 | 0 | 0 |
| 11 | 0 | 0 | 0 | 3 | 3 | 0 | 3 | 3 | 0 | 0 | 0 |
| 12 | 0 | 0 | 3 | 3 | 0 | 0 | 0 | 3 | 3 | 0 | 0 |
| 13 | 0 | 0 | 3 | 3 | 0 | 0 | 0 | 3 | 3 | 0 | 0 |
| 14 | 0 | 2 | 2 | 0 | 0 | 0 | 0 | 0 | 2 | 2 | 0 |
| 15 | 0 | 2 | 2 | 0 | 0 | 0 | 0 | 0 | 2 | 2 | 0 |
| 16 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 |
| 19 | 0 | 0 | 0 | 0 | 0 | 0 | 0 | 0 | 0 | 0 | 0 |

Fig. 6B

ACTUATOR

| DRIVE CYCLE | 1 | 2 | 3 | 4 | 5 | 6 | 7 | 8 | 9 | 10 | 11 |
|---|---|---|---|---|---|---|---|---|---|---|---|
| 1 | 1 | 1 | 1 | 1 | 1 | 1 | 1 | 1 | 1 | 1 | 1 |
| 2 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 |
| 6 | 0 | 0 | 0 | 0 | 0 | 0 | 0 | 0 | 0 | 0 | 0 |
| 7 | 1 | 1 | 1 | 1 | 1 | 1 | 1 | 1 | 1 | 1 | 1 |
| 8 | 0 | 0 | 0 | 0 | 0 | 0 | 0 | 0 | 0 | 0 | 0 |
| 9 | 0 | 0 | 0 | 0 | 0 | 0 | 0 | 0 | 0 | 0 | 0 |
| 10 | 0 | 0 | 0 | 0 | 0 | 0 | 0 | 0 | 0 | 0 | 0 |
| 11 | 0 | 0 | 0 | 0 | 0 | 0 | 0 | 0 | 0 | 0 | 0 |
| 12 | 0 | 0 | 0 | 0 | 0 | 0 | 0 | 0 | 0 | 0 | 0 |
| 13 | 1 | 1 | 1 | 1 | 1 | 1 | 1 | 1 | 1 | 1 | 1 |
| 14 | 0 | 0 | 0 | 0 | 0 | 0 | 0 | 0 | 0 | 0 | 0 |
| 15 | 0 | 0 | 0 | 0 | 0 | 0 | 0 | 0 | 0 | 0 | 0 |
| 16 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 |
| 19 | 1 | 1 | 1 | 1 | 1 | 1 | 1 | 1 | 1 | 1 | 1 |

Fig. 6C

ACTUATOR

| DRIVE CYCLE | 1 | 2 | 3 | 4 | 5 | 6 | 7 | 8 | 9 | 10 | 11 |
|---|---|---|---|---|---|---|---|---|---|---|---|
| 1 | 1 | 1 | 1 | 1 | 1 | 1 | 1 | 1 | 1 | 1 | 1 |
| 2 | 0 | 2 | 2 | 0 | 0 | 0 | 0 | 0 | 2 | 2 | 0 |
| 3 | 0 | 2 | 2 | 0 | 0 | 0 | 0 | 0 | 2 | 2 | 0 |
| 4 | 0 | 0 | 3 | 3 | 0 | 0 | 0 | 3 | 3 | 0 | 0 |
| 5 | 0 | 0 | 3 | 3 | 0 | 0 | 0 | 3 | 3 | 0 | 0 |
| 6 | 0 | 0 | 0 | 3 | 3 | 0 | 3 | 3 | 0 | 0 | 0 |
| 7 | 1 | 1 | 1 | 3 | 3 | 1 | 3 | 3 | 1 | 1 | 1 |
| 8 | 0 | 0 | 0 | 0 | 4 | 4 | 4 | 0 | 0 | 0 | 0 |
| 9 | 0 | 0 | 0 | 0 | 4 | 4 | 4 | 0 | 0 | 0 | 0 |
| 10 | 0 | 0 | 0 | 3 | 3 | 0 | 3 | 3 | 0 | 0 | 0 |
| 11 | 0 | 0 | 0 | 3 | 3 | 0 | 3 | 3 | 0 | 0 | 0 |
| 12 | 0 | 0 | 3 | 3 | 0 | 0 | 0 | 3 | 3 | 0 | 0 |
| 13 | 1 | 1 | 3 | 3 | 1 | 1 | 1 | 3 | 3 | 1 | 1 |
| 14 | 0 | 2 | 2 | 0 | 0 | 0 | 0 | 0 | 2 | 2 | 0 |
| 15 | 0 | 2 | 2 | 0 | 0 | 0 | 0 | 0 | 2 | 2 | 0 |
| 16 | 0 | 0 | 0 | 0 | 0 | 0 | 0 | 0 | 0 | 0 | 0 |
| 17 | 0 | 0 | 0 | 0 | 0 | 0 | 0 | 0 | 0 | 0 | 0 |
| 18 | 0 | 0 | 0 | 0 | 0 | 0 | 0 | 0 | 0 | 0 | 0 |
| 19 | 1 | 1 | 1 | 1 | 1 | 1 | 1 | 1 | 1 | 1 | 1 |

Fig. 7

| HEAD CHIP | | NON-FACING HEAD CHIP | | | END HEAD CHIP | | | FACING HEAD CHIP | | | | | | END HEAD CHIP | | | NON-FACING HEAD CHIP | | |
|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 | 17 | 18 |
| FREQUENCY LEVEL | HIGH DUTY | 1 | 1 | 1 | 3 | 4 | 4 | 2 | 2 | 2 | 2 | 2 | 2 | 4 | 4 | 3 | 1 | 1 | 1 |
| | LOW DUTY | 1 | 1 | 1 | 3 | 5 | 5 | 3 | 3 | 3 | 3 | 3 | 3 | 5 | 5 | 3 | 1 | 1 | 1 |
| FLOWING AMOUNT LEVEL | | 1 | 1 | 1 | 3 | 3 | 3 | 2 | 2 | 2 | 2 | 2 | 2 | 3 | 3 | 3 | 1 | 1 | 1 |

Fig. 8A

ACTUATOR

| DRIVE CYCLE | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 5 | 0 | 0 | 0 | 0 | 0 | 0 | 0 | 0 | 0 | 0 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |
| 8 | 0 | 0 | 0 | 0 | 0 | 0 | 0 | 0 | 0 | 0 |
| 9 | 0 | 0 | 0 | 0 | 0 | 0 | 0 | 0 | 0 | 0 |
| 10 | 0 | 0 | 0 | 0 | 0 | 0 | 0 | 0 | 0 | 0 |
| 11 | 1 | 1 | 1 | 1 | 1 | 1 | 1 | 1 | 1 | 1 |
| 12 | 0 | 0 | 0 | 0 | 0 | 0 | 0 | 0 | 0 | 0 |
| 13 | 0 | 0 | 0 | 0 | 0 | 0 | 0 | 0 | 0 | 0 |
| 14 | 0 | 0 | 0 | 0 | 0 | 0 | 0 | 0 | 0 | 0 |
| 15 | 0 | 0 | 0 | 0 | 0 | 0 | 0 | 0 | 0 | 0 |
| 16 | 0 | 0 | 0 | 0 | 0 | 0 | 0 | 0 | 0 | 0 |
| 17 | 0 | 0 | 0 | 0 | 0 | 0 | 0 | 0 | 0 | 0 |
| 18 | 0 | 0 | 0 | 0 | 0 | 0 | 0 | 0 | 0 | 0 |
| 19 | 0 | 0 | 0 | 0 | 0 | 0 | 0 | 0 | 0 | 0 |

Fig. 8B

ACTUATOR

| DRIVE CYCLE | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 5 | 0 | 0 | 0 | 0 | 0 | 0 | 0 | 0 | 0 | 0 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |
| 8 | 0 | 0 | 0 | 0 | 0 | 0 | 0 | 0 | 0 | 0 |
| 9 | 1 | 1 | 1 | 1 | 1 | 1 | 1 | 1 | 1 | 1 |
| 10 | 0 | 0 | 0 | 0 | 0 | 0 | 0 | 0 | 0 | 0 |
| 11 | 0 | 0 | 0 | 0 | 0 | 0 | 0 | 0 | 0 | 0 |
| 12 | 0 | 0 | 0 | 0 | 0 | 0 | 0 | 0 | 0 | 0 |
| 13 | 0 | 0 | 0 | 0 | 0 | 0 | 0 | 0 | 0 | 0 |
| 14 | 0 | 0 | 0 | 0 | 0 | 0 | 0 | 0 | 0 | 0 |
| 15 | 0 | 0 | 0 | 0 | 0 | 0 | 0 | 0 | 0 | 0 |
| 16 | 0 | 0 | 0 | 0 | 0 | 0 | 0 | 0 | 0 | 0 |
| 17 | 1 | 1 | 1 | 1 | 1 | 1 | 1 | 1 | 1 | 1 |
| 18 | 0 | 0 | 0 | 0 | 0 | 0 | 0 | 0 | 0 | 0 |
| 19 | 0 | 0 | 0 | 0 | 0 | 0 | 0 | 0 | 0 | 0 |

Fig. 8C

ACTUATOR

| DRIVE CYCLE | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 5 | 0 | 0 | 0 | 0 | 0 | 0 | 0 | 0 | 0 | 0 |
| 6 | 0 | 0 | 0 | 0 | 0 | 0 | 0 | 0 | 0 | 0 |
| 7 | 1 | 1 | 1 | 1 | 1 | 1 | 1 | 1 | 1 | 1 |
| 8 | 0 | 0 | 0 | 0 | 0 | 0 | 0 | 0 | 0 | 0 |
| 9 | 0 | 0 | 0 | 0 | 0 | 0 | 0 | 0 | 0 | 0 |
| 10 | 0 | 0 | 0 | 0 | 0 | 0 | 0 | 0 | 0 | 0 |
| 11 | 0 | 0 | 0 | 0 | 0 | 0 | 0 | 0 | 0 | 0 |
| 12 | 0 | 0 | 0 | 0 | 0 | 0 | 0 | 0 | 0 | 0 |
| 13 | 1 | 1 | 1 | 1 | 1 | 1 | 1 | 1 | 1 | 1 |
| 14 | 0 | 0 | 0 | 0 | 0 | 0 | 0 | 0 | 0 | 0 |
| 15 | 0 | 0 | 0 | 0 | 0 | 0 | 0 | 0 | 0 | 0 |
| 16 | 0 | 0 | 0 | 0 | 0 | 0 | 0 | 0 | 0 | 0 |
| 17 | 0 | 0 | 0 | 0 | 0 | 0 | 0 | 0 | 0 | 0 |
| 18 | 0 | 0 | 0 | 0 | 0 | 0 | 0 | 0 | 0 | 0 |
| 19 | 1 | 1 | 1 | 1 | 1 | 1 | 1 | 1 | 1 | 1 |

Fig. 8D

ACTUATOR

| DRIVE CYCLE | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 0 | 0 | 0 | 0 | 0 |
| 5 | 1 | 1 | 1 | 1 | 1 | 1 | 1 | 1 | 1 | 1 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |
| 8 | 0 | 0 | 0 | 0 | 0 | 0 | 0 | 0 | 0 | 0 |
| 9 | 1 | 1 | 1 | 1 | 1 | 1 | 1 | 1 | 1 | 1 |
| 10 | 0 | 0 | 0 | 0 | 0 | 0 | 0 | 0 | 0 | 0 |
| 11 | 0 | 0 | 0 | 0 | 0 | 0 | 0 | 0 | 0 | 0 |
| 12 | 0 | 0 | 0 | 0 | 0 | 0 | 0 | 0 | 0 | 0 |
| 13 | 1 | 1 | 1 | 1 | 1 | 1 | 1 | 1 | 1 | 1 |
| 14 | 0 | 0 | 0 | 0 | 0 | 0 | 0 | 0 | 0 | 0 |
| 15 | 0 | 0 | 0 | 0 | 0 | 0 | 0 | 0 | 0 | 0 |
| 16 | 0 | 0 | 0 | 0 | 0 | 0 | 0 | 0 | 0 | 0 |
| 17 | 1 | 1 | 1 | 1 | 1 | 1 | 1 | 1 | 1 | 1 |
| 18 | 0 | 0 | 0 | 0 | 0 | 0 | 0 | 0 | 0 | 0 |
| 19 | 0 | 0 | 0 | 0 | 0 | 0 | 0 | 0 | 0 | 0 |

Fig. 8E

ACTUATOR

| DRIVE CYCLE | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 1 | 1 | 1 | 1 | 1 | 1 | 1 | 1 | 1 | 1 |
| 4 | 0 | 0 | 0 | 0 | 0 | 0 | 0 | 0 | 0 | 0 |
| 5 | 1 | 1 | 1 | 1 | 1 | 1 | 1 | 1 | 1 | 1 |
| 6 | 0 | 0 | 0 | 0 | 0 | 0 | 0 | 0 | 0 | 0 |
| 7 | 1 | 1 | 1 | 1 | 1 | 1 | 1 | 1 | 1 | 1 |
| 8 | 0 | 0 | 0 | 0 | 0 | 0 | 0 | 0 | 0 | 0 |
| 9 | 1 | 1 | 1 | 1 | 1 | 1 | 1 | 1 | 1 | 1 |
| 10 | 0 | 0 | 0 | 0 | 0 | 0 | 0 | 0 | 0 | 0 |
| 11 | 1 | 1 | 1 | 1 | 1 | 1 | 1 | 1 | 1 | 1 |
| 12 | 0 | 0 | 0 | 0 | 0 | 0 | 0 | 0 | 0 | 0 |
| 13 | 1 | 1 | 1 | 1 | 1 | 1 | 1 | 1 | 1 | 1 |
| 14 | 0 | 0 | 0 | 0 | 0 | 0 | 0 | 0 | 0 | 0 |
| 15 | 1 | 1 | 1 | 1 | 1 | 1 | 1 | 1 | 1 | 1 |
| 16 | 0 | 0 | 0 | 0 | 0 | 0 | 0 | 0 | 0 | 0 |
| 17 | 1 | 1 | 1 | 1 | 1 | 1 | 1 | 1 | 1 | 1 |
| 18 | 0 | 0 | 0 | 0 | 0 | 0 | 0 | 0 | 0 | 0 |
| 19 | 1 | 1 | 1 | 1 | 1 | 1 | 1 | 1 | 1 | 1 |

Fig. 13

| TEMPERATURE(°C ) | SHIFT AMOUNT |
|---|---|
| LESS THAN 10 | +2 |
| EQUAL TO OR MORE THAN 10 AND LESS THAN15 | +1 |
| EQUAL TO OR MORE THAN 15 AND LESS THAN 20 | 0 |
| EQUAL TO OR MORE THAN 20 AND LESS THAN 25 | 0 |
| EQUAL TO OR MORE THAN 25 AND LESS THAN 30 | 0 |
| EQUAL TO OR MORE THAN 30 AND LESS THAN 35 | 0 |
| EQUAL TO OR MORE THAN 35 AND LESS THAN 40 | -1 |
| EQUAL TO OR MORE THAN 40 | -2 |

Fig. 14

| HUMIDITY(%) | SHIFT AMOUNT |
|---|---|
| LESS THAN 30 | +2 |
| EQUAL TO OR MORE THAN 30 AND LESS THAN 40 | +1 |
| EQUAL TO OR MORE THAN 40 AND LESS THAN 50 | 0 |
| EQUAL TO OR MORE THAN 50 AND LESS THAN 60 | 0 |
| EQUAL TO OR MORE THAN 60 AND LESS THAN 70 | -1 |
| EQUAL TO OR MORE THAN 70 | -2 |

LIQUID DISCHARGE APPARATUS, LIQUID DISCHARGE METHOD AND NON TRANSITORY COMPUTER-READABLE MEDIUM STORING CONTROL PROGRAM FOR LIQUID DISCHARGE APPARATUS

CROSS REFERENCE TO RELATED APPLICATION

The present application claims priority from Japanese Patent Application No. 2019-139079 filed on Jul. 29, 2019, the disclosure of which is incorporated herein by reference in its entirety.

BACKGROUND

Field of the Invention

The present disclosure relates to a liquid discharge apparatus, a liquid discharge method, and a non-transitory computer-readable medium storing a control program for the liquid discharge apparatus.

Description of the Related Art

There is conventionally known an ink-jet printer including: an ink-jet head including nozzles; a circulation channel through which ink circulates between the ink-jet head and a tank; and a battery storing electric power for maintenance. When electric power is supplied from an external power source to the ink-jet printer, the ink-jet printer performs a precursor for applying vibration to ink without discharging ink from nozzles, and circulates ink through the circulation channel. When electric power is not supplied from the external power source, the ink-jet printer performs the precursor using electric power of the battery without the ink circulation.

SUMMARY

In the above ink-jet printer, a maintenance method for handling the deterioration in image quality due to drying of ink is changed depending on Whether or not electric power is supplied from the external source. When electric power is supplied to the ink-jet printer, the precursor and the ink circulation are typically performed. Thus, the reduction in power consumption for maintenance and the reduction in heat generation by maintenance have room for improvement.

The present disclosure is made to solve such a problem, and an object of the present disclosure is to provide a liquid discharge apparatus, a liquid discharge method, and a program that are capable of reducing power consumption and heat generation for maintenance while inhibiting deterioration in image quality due to drying of ink.

According to an aspect of the present disclosure, there is provided a liquid discharge apparatus, including: a conveyer configured to convey a recording medium in a conveyance direction; a plurality of head chips aligned in a width direction orthogonal to the conveyance direction. Each of the head chips includes: a manifold; a nozzle group including a plurality of nozzles communicating with the manifold; and a plurality of actuators corresponding to the nozzles. Each of the head chips is configured to execute discharge drive and non-discharge vibration drive. A liquid is discharged from a nozzle included in the nozzles in the discharge drive, and a meniscus of a nozzle included in the nozzles is vibrated without discharging the liquid from the nozzle in the non-discharge vibration drive. The liquid discharge apparatus further includes: a circulation channel and a controller. The liquid circulates between the manifold and a tank containing the liquid through the circulation channel. The head chips include: an end head chip facing an end of the recording medium in the width direction; a facing head chip adjacent to a first side of the end head chip in the width direction and facing the recording medium; and a non-facing head chip adjacent to a second side of the end head chip in the width direction and not facing the recording medium. The controller is configured to make at least one of a circulation flowing amount of the liquid in the circulation channel in the facing head chip and a frequency of the non-discharge vibration drive by an actuator included in the actuators in the facing head chip larger titan at least one of a circulation flowing amount of the liquid in the circulation channel in the non-facing facing head chip and a frequency of the non-discharge vibration drive by an actuator included in the actuators in the non-facing head chip.

In the above liquid discharge apparatus, air current is generated by conveying the recording medium. Due to the air current, ink in the nozzle in the facing head chip that faces the recording medium is more likely to dry than that in the non-facing head chip. Thus, the circulation flowing amount and the frequency of the non-discharge vibration drive in the facing head chip are made to be larger than the non-facing head chip. This inhibits the deterioration in image quality in the facing head chip due to the drying of liquid, such as ink.

On other hand, in the non-facing head chip not facing the recording medium, the effect of the air current due to the conveyance of the recording medium is smaller than the facing head chip, and thus the liquid in the non-facing head chip is not likely to be dried by the air current. Thus, the circulation flowing amount and the frequency of the non-discharge vibration drive in the non-facing head chip are made to be smaller than the facing head chip. This reduces the power consumption and heat generation required for the circulation and the non-discharge vibration drive.

According to the present disclosure, it is possible to provide a liquid discharge apparatus, a liquid discharge method, and a non-transitory computer-readable medium storing a program that are capable of reducing power consumption and heat generation for maintenance while inhibiting deterioration in image quality due to drying of liquid.

BRIEF DESCRIPTION OF THE DRAWINGS

FIG. 3 depicts a discharge head in FIG. 1 when seem from a discharge surface side.

FIG. 6A is discharge drive data, FIG. 6B is non-discharge vibration drive data, and FIG. 6C is actuator drive data.

FIG. 7 is a table indicating head chips, frequency levels of non-discharge vibration drive, and flowing amount levels of an ink circulating through circulation channels.

FIG. 8A is non-discharge vibration drive data of an operation pattern 1, FIG. 8B is non-discharge vibration drive data of an operation pattern 2, FIG. 8C is non-discharge vibration drive data of an operation pattern 3, FIG. 8D is non-discharge vibration drive data of an operation pattern 4, and FIG. 8E is non-discharge vibration drive data of a operation pattern 5.

FIG. 13 is a correspondence relationship table between temperatures and shift amounts.

FIG. 14 is a correspondence relationship table between humidity and shift amounts.

DESCRIPTION OF THE EMBODIMENTS

First Embodiment

<Configuration of Liquid Discharge Apparatus>

Figure 1:
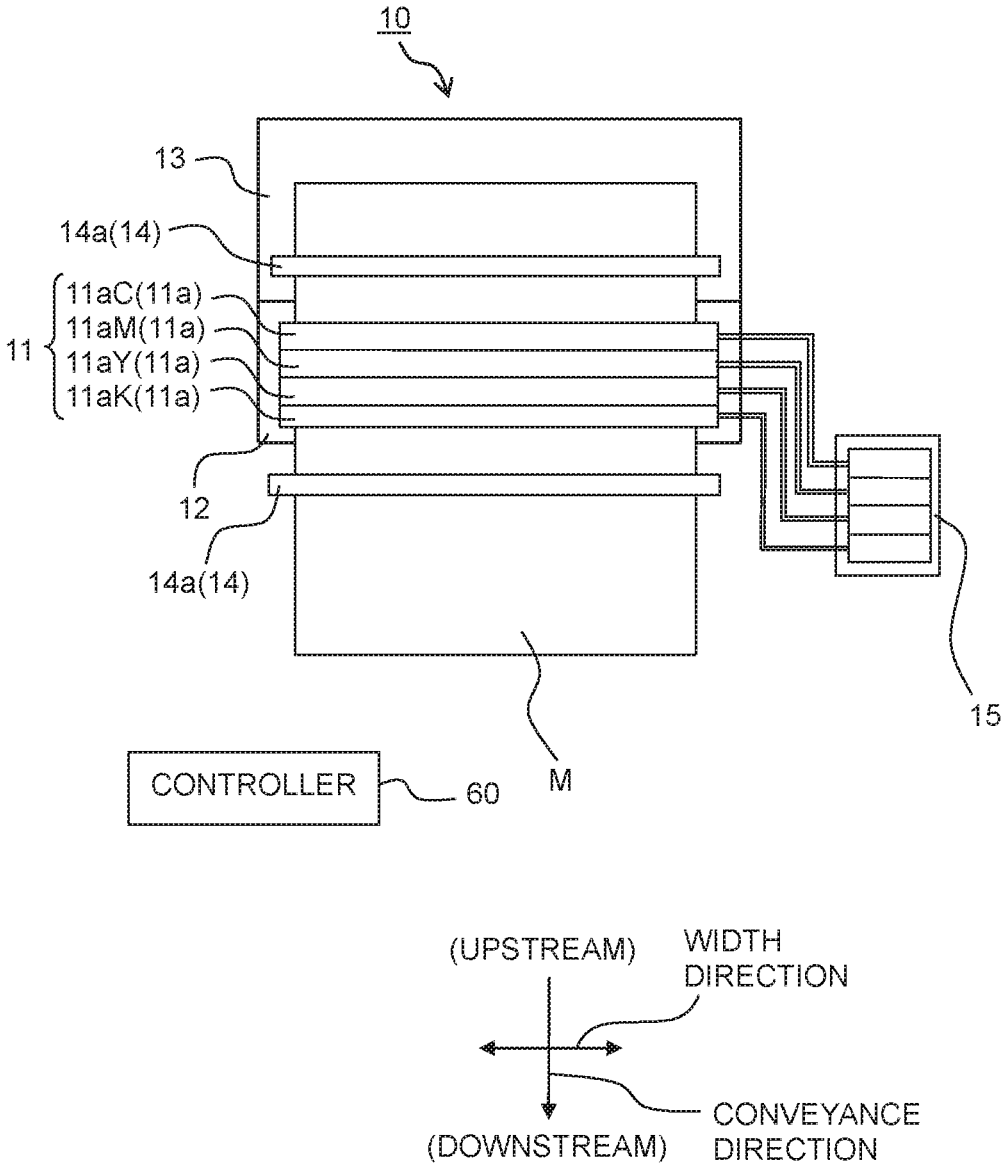
FIG. 1 depicts a schematic configuration of a liquid discharge apparatus according to the first embodiment of the present disclosure.

As a liquid discharge apparatus 10 according to the first embodiment (see FIGS. 1 and 2), an ink-jet printer that performs printing on a recording medium M by discharging ink is explained below. The liquid discharge apparatus 10 is not limited to the ink-jet printer that discharges ink as a liquid. The liquid discharge apparatus 10 may be a liquid discharge apparatus that discharges any other liquid than ink.

The liquid discharge apparatus 10 of a line head system is adopted in the first embodiment. The liquid discharge apparatus 10 includes a head unit 11, a platen 12, a tray 13, a conveyer 14, storing tanks 15, and a controller 60. The head unit 11 includes one or more (e.g. four) discharge head(s) 11*a*. The discharge heads 11*a* are longer than the recording medium M in a width direction.

Each discharge head 11*a* includes a channel forming body and a volume change portion. The inside of the channel forming body is provided with channels, and nozzles 21 are opened in its lower surface (discharge surface 40*a*). The volume change portion is driven to change a volume of the channel. On this occasion, a meniscus in the opening (nozzle hole 21*a*) of the nozzle 21 is displaced to vibrate, thus discharging an ink particle(s) (ink droplet(s)), Details of the discharge head 11*a* are described below.

The platen 12 is a flat plate member. The recording medium M is placed on its upper surface. The platen 12 determines a distance between the recording medium M and the discharge surface 40*a* facing the recording medium M. The side closer to the discharge surface 40*a* with the platen 12 as a reference is referred to as an upper side, and the opposite side thereof is referred to as a lower side. The arrangement of the liquid discharge apparatus 10, however, is not limited thereto.

The tray 13 is disposed at an upstream side of the platen 12 in a conveyance direction, which is orthogonal to the width direction. The tray 13 accommodates the recording medium(s) M. The conveyer 14 includes, for example, two conveyance rollers 14*a* and a conveyance motor 14*b*. The two conveyance rollers 14*a* interpose the platen 12 in the conveyance direction. The two conveyance rollers 14*a* are parallel to each other. The conveyance motor 14*h* is coupled to the conveyance rollers 14*a*. Driving the conveyance motor 14*b* rotates the conveyance rollers 14*a*. This feeds the recording medium M from the tray 13 and conveys the recording medium M on the platen 12 in the conveyance direction.

The storing tanks 15 are, for example, removable cartridges. The storing tanks are provided corresponding to kinds of inks. For example, four storing tanks 15 may respectively contain inks of black, yellow, cyan, and magenta. Each of the storing tanks 15 is connected to the corresponding one of the discharge heads 11*a* via a tube.

For example, the cyan ink is supplied to the nozzles 21 of a discharge head 11*a*C included in the discharge tanks 11*a* and connected to the storing tank 15 for cyan. The magenta ink is supplied to the nozzles 21 of a discharge head 11*a*M included in the discharge tanks 11*a* and connected to the storing tank 15 for magenta. The yellow ink is supplied to the nozzles 21 of a discharge head 11*a*Y included in the discharge tanks 11*a* and connected to the storing tank 15 for yellow. The black ink is supplied to the nozzles 21 of a discharge head 11*a*K included in the discharge tanks 11*a* and connected to the storing tank 15 for black. For example, the discharges heads 11*a*C, 11*a*M, 11*a*Y, and 11*a*K are aligned in this order from the upstream side to the downstream side in the conveyance direction.

The controller 60 is connected to drive circuits that drive respective sections or units of the liquid discharge apparatus 10. The controller 60 controls the drive of the respective sections by outputting control data to the respective drive circuits. For example, the controller 60 is connected to a conveyance motor drive circuit 16 that drives the conveyance motor 14*b*, and to an actuator drive circuit 17 that drives an actuator 30 of each volume change portion.

The controller 60 thus executes a pass process including a recording process and a conveyance process. In the recording process, dots are formed on the recording medium M by discharging different amounts of ink droplets from the nozzles 21 of the discharge head 11*a*. In the conveyance process, the recording medium M is conveyed in the conveyance direction. One recording process and the subsequent conveyance process are referred to as one pass. The controller 60 performs a printing process by alternately repeating the recording process and the conveyance process. Details of the controller 60 and the respective drive circuits are described below.

<Construction of Discharge Head>

As depicted in FIG. 3, each discharge head 11*a* includes head chips 20 (e.g., 18 head chips). The head chips 20 are arranged zigzag in the width direction such that the nozzles 21 provided in the head chips 20 are arranged in the width direction at predefined intervals. For example, the head chips 20 are aligned in two rows, and the two rows of the head chips 20 are arranged in the conveyance direction. The head chips 20 belonging to one of the rows and the head chips 20 belonging to the other are staggered from each other in the width direction.

Each head chip 20 includes a nozzle group including the nozzles 21. In the nozzle group, the nozzles 21 are aligned in the width direction to form nozzle rows. The nozzle rows e.g., two nozzle rows) are arranged in the conveyance direction. The nozzles 21 belonging to one of the nozzle rows and the nozzles 21 belonging to the other are staggered from each other in the width direction.

Figure 4:
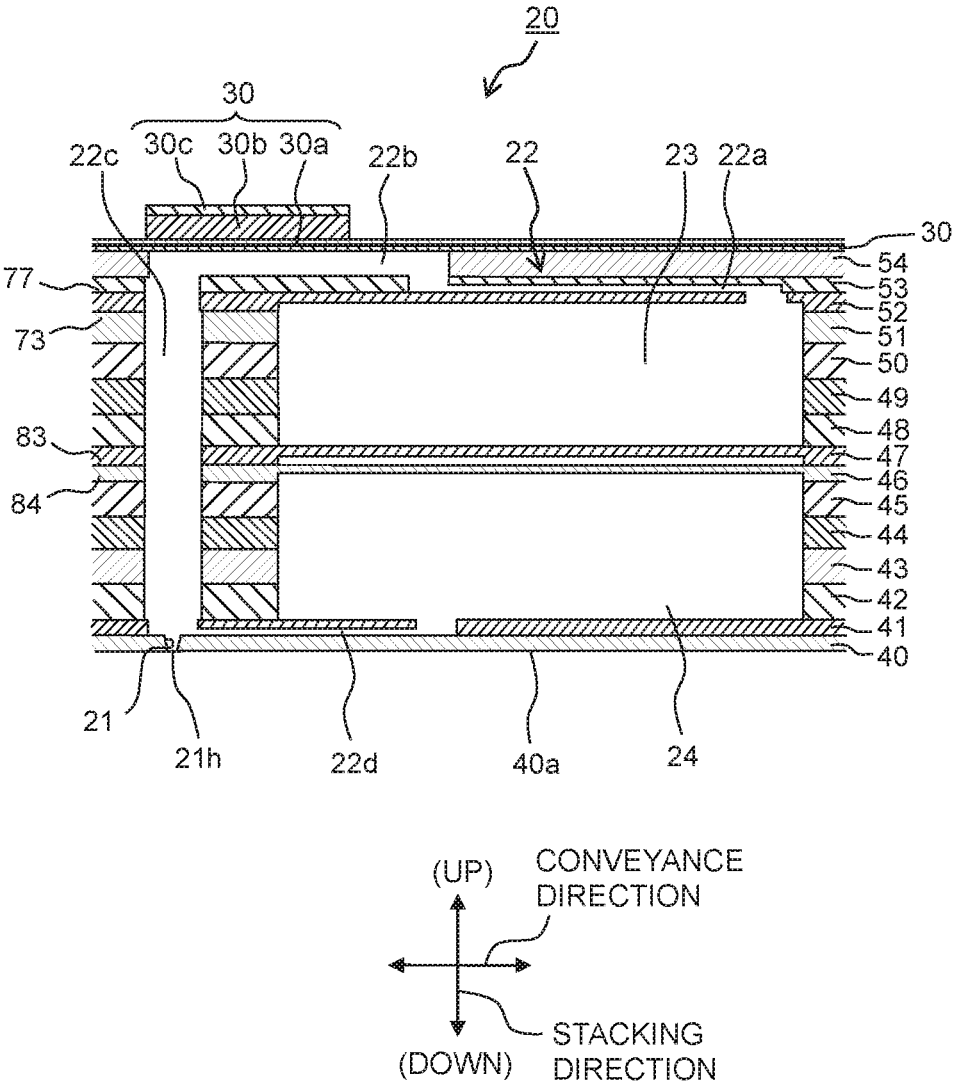
FIG. 4 is a cross-sectional view of a head chip in FIG. 1.
Figure 5:
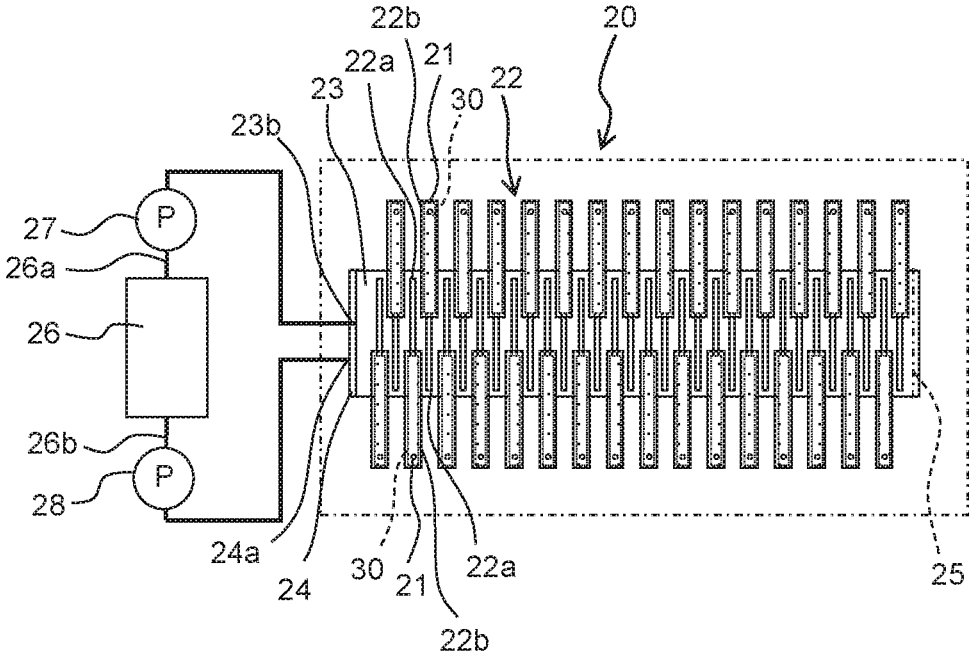
FIG. 5 schematically depicts the head chip in FIG. 1 and a subtank.

As depicted in FIGS. 4 and 5, each head chip 20 includes the channel forming body and the volume change portion. The channel forming body is formed by a stacked body of plates. The plates include a nozzle plate 40 and the first channel plate 41 to the fourteenth channel plate 54 that are stacked in this order.

Each plate includes holes with different diameters and grooves with different widths (lengths). In the stacked body formed by stacking the plates, the holes and grooves are combined to form channels. The channels include the nozzles 21, individual channels 22, a supply manifold 23, and a return manifold 24. The nozzles 21 are formed by through holes passing through the nozzle plate 40 in its thickness direction. The nozzles 21 are opened in the lower surface (discharge surface 40*a*) of the nozzle plate 40.

The supply manifold 23 extends in the width direction. The first end of the supply manifold 23 is provided with a supply opening 23*a*. The return manifold 24 extends in the width direction. The first end of the return manifold 24 is provided with a return opening 24*a*. The supply manifold 23 and the return manifold 24 are stacked in a stacking direction. The second end of the supply manifold 23 is connected to the second end of the return manifold 24 by using a communicating channel 25.

The supply manifold 23 and the return manifold 24 are connected to a subtank 26. For example, the subtank 26 is connected to the supply opening 23*a* by using a supply channel 26*a*, and the subtank 26 is connected to the return opening 24*a* by using a return channel 26*b*. The individual channels 22 are connected to the manifolds 23 and 24. Each of the individual channels 22 extends from the supply manifold 23 to the corresponding one of the nozzles 21 and further extends from the corresponding nozzle 21 to the return manifold 24.

In the above configuration, the subtank 26, the supply channel 26*a*, the supply manifold 23, the communicating channel 25 and the return manifold 24, and the return channel 26*b* and the subtank 26 form a manifold circulation channel 33 through which ink circulates in that order. In other words, ink circulates between the supply manifold 23 and the subtank 26. Ink also circulates between the return manifold 24 and the subtank 26. Further, the subtank 26, the supply channel 26*a*, the supply manifold 23, the individual channels 22 and the return manifold 24, and the return channel 26*b* and the subtank 26 form a nozzle circulation channel 34 (circulation channel) through which ink circulates in that order.

The supply channel 26*a* is provided with a positive pressure pump 27 for supplying ink from the subtank 26 to the supply manifold 23. The return channel 26*b* is provided with a negative pressure pump 28 for discharging ink from the return manifold 24 to the subtank 26. The positive pressure pump 27 and the negative pressure pump 28 are provided in the circulation channels 33, 34 for each head chip 20. However, any one or both of the positive pressure pump 27 and the negative pressure pump 28 may be provided in the manifold circulation channel 33. Or, any one of the positive pressure pump 27 and the negative pressure pump 28 may be provided in the subtank 26.

The individual channels 22 connected to the manifolds 23, 24 communicate with the nozzles 21 forming the nozzle group. In this embodiment, since the nozzle group is formed by the nozzles 21 belonging to the two nozzle rows, the nozzles 21 belonging to the two nozzle rows are connected to the supply manifold 23 and the return manifold 24. Accordingly, the nozzle group in each head chip 20 includes the nozzles 21 communicating with the manifolds 23, 24.

Each individual channel 22 includes a supply-side throttle channel 22*a*, a pressure chamber 22*b*, a descender 22*c*, and a return-side throttle channel 22*d* which are connected to each other in this order. Since the nozzle 21 is connected to the descender 22*c*, the pressure chamber 22*b* communicates with the nozzle 21 via the descender 22*c*.

In such a channel, at least any one of the positive pressure pump 27 and the negative pressure pump 28 is driven. When at least any one of the positive pressure pump 27 and the negative pressure pump 28 is driven, ink flows from the subtank 26, passes through the supply channel 26*a*, and flows into the supply manifold 23 via the supply opening 23*a*. The ink flowing through the supply manifold 23 diverges into the individual channels 22 connected to the supply manifold 23. In each individual channel 22, ink flows through the supply-side throttle channel 22*a*, the pressure chamber 22*b*, and the descender 22*c* in this order. Then, the ink flows into the nozzle 21 and discharged from the nozzle 21.

Here, ink not flowing into the nozzle 21 flows from the descender 22*c* into the return manifold 24 via the return-side throttle channel 22*d*. Accordingly, ink flows through the nozzle circulation channel 34.

Ink not flowing into the individual channels 22 from the supply manifold 23 flows into the return manifold 24 from the supply manifold 23 via the communicating channel 25. Then, ink passes through the return manifold 24, flows out of the return opening 24*a*, passes through the return channel 26*b*, and returns to the subtank 26. Accordingly, ink flows through the manifold circulation channel 33.

The volume change portion is disposed on the fourteenth channel plate 54. The volume change portion includes the actuator 30 and a vibration plate 31. The pressure chamber 22*b* passes through the fourteenth channel plate 54 in its thickness direction. The vibration plate 31 is fixed onto the fourteenth channel plate 54 to cover the openings of the pressure chambers 22*b*.

The actuator 30 is a piezoelectric element that includes a common electrode 30*a*, a piezoelectric layer 30*b*, and an individual electrode 30*c*. The actuator 30 is disposed on the vibration plate 31. The common electrode 30*a* covers an entire surface of the vibration plate 31. The piezoelectric layer 30*b* is stacked on the common electrode 30*a*. The individual electrode 30*c* is disposed on the piezoelectric layer 30*b* to correspond to each pressure chamber 22*b*. One actuator 30 is formed by one individual electrode 30*c*, the common electrode 30*a*, and the partial piezoelectric layer 30*b* interposed between individual electrode 30*c* and the common electrode 30*a*.

The individual electrodes 30*c* are connected to the actuator drive circuit 17 (FIG. 2), and a drive signal from the actuator drive circuit 17 is applied to the individual electrodes 30*c*. On the other hand, the common electrode 30*a* is constantly kept at a ground potential. The electric potential of the individual electrodes 30*c* is the same as that of the common electrode 30*a* in a state where the drive signal is not applied to the individual electrodes 30*c*.

When the drive signal is applied to a certain individual electrode 30*c* included in the individual electrodes 30*c*, an active portion (partial piezoelectric layer 30*h* interposed between the individual electrode 30*c* and the common electrode 30*a*) of the piezoelectric layer 30*b* contracts in a planar direction together with the two electrodes 30*a*, 30*c*. The vibration plate 31 is deformed by cooperating with the actuator 30, which changes the volume of the pressure chamber 22*h*. This applies pressure to the ink in the pressure chamber 22*b*, thus vibrating the meniscus of the nozzle hole 21*a* or discharging ink droplet(s) from the nozzle hole 21*a*. Namely, the actuator 30 is capable of executing discharge drive and non-discharge vibration drive. In the discharge drive, ink is discharged from the nozzle 21. In the non-discharge vibration drive, the meniscus of the nozzle 21 is vibrated without discharging ink from the nozzle 21. The discharge drive and the non-discharge vibration drive are described later.

<Controller and Drive Circuit>

Figure 2:
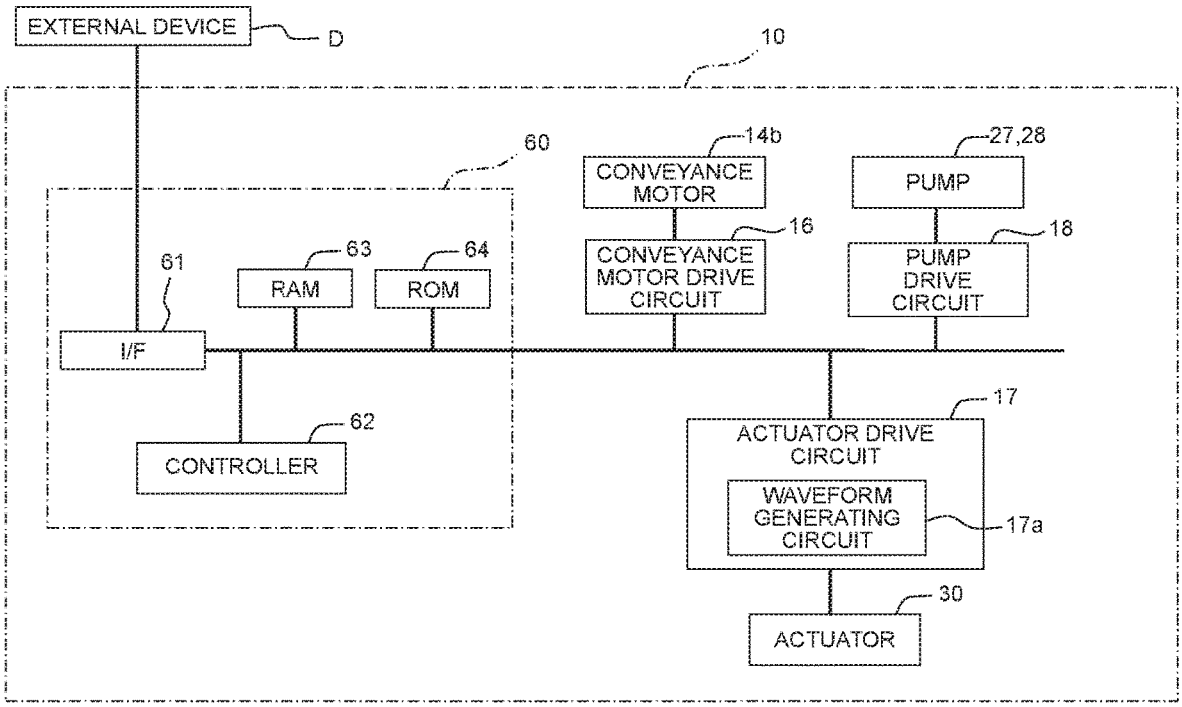
FIG. 2 is a block diagram depicting a functional configuration of the liquid discharge apparatus in FIG. 1.

As depicted in FIG. 2, the controller 60 includes an interface (I/F 61), a controller 62, and a memory. The I/F 61 receives a variety of data such as printing data, from an external apparatus D such as a computer, a camera, a network, and a recording medium, directly or via a network or the like. The printing data includes image data and setting data. The image data indicates an image to be printed on the recording medium M. The image data includes color information and gradation information. The setting data indicates a printing condition. The setting data includes a size of the recording medium M to be used for printing.

The memory is accessible through the controller 62. The memory includes a RAM 63 and a ROM 64, The RAM 63 temporarily saves a variety of data. Examples of the variety of data include the printing data and data converted by the controller 62.

The ROM 64 stores a computer program and a control program for executing a variety of data processes. The computer program may be obtained from the external apparatus D via the I/F 61.

The controller 62 includes a calculation processing apparatus, such as a processor. The controller 62 controls sections or units of the liquid discharge apparatus 10 by executing the computer program stored in the ROM 64. For example, the controller 62 saves, in the RAM 63, a variety of data or the like sent via the I/F 61.

The controller 62 executes a setting process through the computer program. In the setting process, at least one of a circulation flowing amount of the ink in the circulation channels 33, 34 and a frequency of the non-discharge vibration drive by the actuator 30 in a facing head chip 20 to be described is made to be larger than that in a non-facing head chip 20 to be described. The controller 62 saves the obtained and processed data in the RAM 63. The setting process is described later.

The controller 62 generates control data for controlling the respective drive circuits based on the printing data, and outputs the control data to the respective drive circuits. The drive circuits include the conveyance motor drive circuit 16, a pump drive circuit 18, and the actuator drive circuit 17.

For example, the conveyance motor drive circuit 16 controls the drive of the conveyance motor 14*b* based on conveyance motor control data from the controller 62. The pump drive circuit 18 controls the drive of the pumps 27, 28 based on pump control data from the controller 62. The actuator drive circuit 17 controls the drive of the actuator 30 based on actuator control data from the controller 62. The actuator drive circuit 17 includes a waveform generating circuit 17*a*. The drive control of the actuator 30 is described below.

<Drive Control of Actuator>

The controller 62 obtains the printing data from the external apparatus D via the I/F 61. Image data of the printing data includes a gradation value for each color of an image. When the image data is represented by an RGB color space, this image data is converted into data represented by a CMYK color space. The controller 62 generates dot data and selection data based on the printing data, and outputs them to the actuator drive circuit 17.

The dot data defines a dot to be formed on the recording medium M by ink to be discharged from the nozzle 21. The dot data is formed from the gradation value for each color of the image data. The dot data includes dot position information and dot size information. For example, a half tone is used.

Since the dot is formed by the ink to be discharged from the nozzle 21, a dot position corresponds to a position of the nozzle 21 and a discharge timing from the nozzle 21. Further, dot sizes included in the dot size information include a small dot of which dot size is small, a medium dot of which dot size is larger than the small dot, a large dot of which dot size is larger than the medium dot, and no dot by which no dot is formed.

The selection data is data for selecting an operation pattern, depending on the frequency of the non-discharge vibration drive, from among operation patterns for the non-discharge vibration drive of the actuator 30. The non-discharge vibration drive vibrates the meniscus of the nozzle 21 (non-discharge drive) without discharging ink from the nozzle 21. The non-discharge vibration drive is executed for inhibiting the drying of ink in the nozzle 21.

As depicted in FIGS. 8A to 8E, for example, operation patterns corresponding to five frequency levels are set. The frequency levels are associated with the frequencies of the non-discharge vibration drive so that the frequency of the non-discharge vibration drive is larger, as the frequency level is higher. In FIGS. 8A to 8E, a horizontal direction indicates the actuators 30 as drive targets, and a vertical direction indicates drive cycles. Here, "0" indicates non-drive by which no actuator 30 is driven. "1" indicates the non-discharge vibration drive.

In an operation pattern corresponding to a frequency level 1 depicted in FIG. 8A, the non-discharge vibration drive is executed for the first cycle in all the actuators 30 of the head chip 20. The actuators 30 are not driven in nine cycles from the second to the tenths cycles. The drive and the non-drive are repeated as described above in this operation pattern. In an operation pattern corresponding to a frequency level 2 depicted in FIG. 8B, the non-discharge vibration drive is executed in the first cycle, and the actuators 30 are not driven in subsequent seven cycles.

In an operation pattern corresponding to a frequency level 3 depicted in FIG. 8C, the non-discharge vibration drive is executed in the first cycle, and the actuators 30 are not driven in subsequent five cycles. In an operation pattern corresponding to a frequency level 4 depicted in FIG. 8D, the non-discharge vibration drive is executed in the first cycle, and the actuators 30 are not driven in subsequent three cycles. In an operation pattern corresponding to a frequency level 5 depicted in FIG. 8E, the non-discharge vibration drive is executed in the first cycle, and the actuators 30 are not driven in subsequent one cycle.

The actuator drive circuit 17 combines discharge drive data depending on the dot data and non-discharge vibration drive data corresponding to an operation pattern selected by the selection data, thus generating drive data for driving the actuator 30.

For example, the actuator drive circuit 17 generates the discharge drive data from the dot data. The discharge drive data includes data related to the actuator 30 corresponding to the nozzle 21, a drive timing thereof and a drive type thereof. The drive timing is set for a drive cycle unit of the actuator 30 depending on, for example, the position of the dot in the image to be formed on the recording medium M.

The drive type is defined by the dot size. For example, medium droplet discharge drive, in which a medium ink droplet having a predefined volume (predefined ink amount) is discharged from the nozzle 21, is defined for the medium dot. Small droplet discharge drive, in which a small ink droplet having a smaller ink amount than the medium ink droplet is discharged from the nozzle 21, is defined for the small dot. Large droplet discharge drive, in which a large ink droplet having a larger ink amount than the medium ink droplet is discharged from the nozzle 21, is defined for the large dot. Non discharge is set for no dot so as not to discharge ink from the nozzle 21.

In the discharge drive data in FIG. 6A, a horizontal direction indicates the actuators 30 corresponding to the respective nozzles 21 and a vertical direction indicates drive cycles of the actuators 30. Here, "0" indicates the non-discharge, "2" indicates the small droplet discharge drive, "3" indicates the medium droplet discharge drive, and "4" indicates the large droplet discharge drive. Ink is thus discharged from the nozzle 21 when the discharge drive is any of "2" to "4", thus forming the dot on the recording medium M.

The actuator drive circuit 17 selects one operation pattern, from among the operation patterns indicated by FIGS. 8A to 8E, based on the selection data, and generates data of the non-discharge vibration drive of the selected operation pattern. For example, the actuator drive circuit 17 selects the operation pattern having the frequency level 3 indicated in FIG. 6B.

The discharge drive data in FIG. 6A and the non-discharge vibration drive data in FIG. 6B are generated as described above. The actuator drive circuit 17 replaces the discharge drive data of any of "2" to "4" included in the discharge drive data with the data of any of "0" to "1" included in the non-discharge vibration drive data based on the actuator 30 as the drive target and the drive cycle, and generates the drive data in FIG. 6C.

The waveform generating circuit 17*a* of the actuator drive circuit 17 generates a drive signal of a voltage waveform based on the drive data of the actuator 30, and supplies the drive signal to the actuator 30. The actuator 30 drives depending on the supplied drive signal. The waveform generating circuit 17*a* does not generate the drive signal for the drive data "0", and no drive signal is supplied to the actuator 30.

The actuator 30 executes an operation depending on each drive signal. For example, according to the drive signal depending on the drive data in FIG. 6C, the third actuator 30 executes the non-discharge vibration drive in the first drive cycle, executes the small droplet discharge drive continuously in the second and third drive cycles, executes the medium droplet discharge drive continuously in the fourth and fifth drive cycles, executes no drive in the sixth drive cycle, and executes the non-discharge vibration drive in the seventh drive cycle, <Setting Process>

As depicted in FIG. 3, each discharge head 11*a* includes head chips 20 aligned in the width direction. Each discharge head 11*a* may extend beyond the recording medium M in the width direction. In this case, although the discharge surface (s) 40*a* of head chip(s) 20 that are included in the head chips 20 and are disposed at a center side in the width direction face the recording medium M, the discharge surfaces 40*a* of head chips 20 that are included in the head chips 20 and are disposed at sides separated from the center side (head end sides) do not face the recording medium M.

Air current is caused by the movement of the recording medium M in the conveyance direction. Due to this air current, ink in the nozzles 21 in the discharge surface(s) 40*a* facing the recording medium M dries more easily than ink in the nozzles 21 in the discharge surfaces 40*a* not facing the recording medium M. In view of this, the controller 62 controls the frequency of the non-discharge vibration drive of the actuators 30 corresponding to the nozzles 21 and the circulation flowing amount of ink in the circulation channels 33, 34 of the head chips 20.

Specifically, each discharge head 11*a* includes end head chips 20, the facing head chip(s) 20, and the non-facing head chip(s) 20 depending on a positional relationship with the recording medium M in the width direction. In FIG. 3, in the discharge head 11*a*, the first head chip 20*a* to the eighteenth head chip 20*r* are aligned and each head chip 20 includes the nozzle group.

The end head chips 20 include head chips 20 facing ends (sheet ends ME) in the width direction of the recording medium M. Each of the end head chips 20 includes an end nozzle group that faces an end area E, which is a predefined range from the corresponding sheet end ME. The discharge head 11*a* is provided with a pair of end head chips 20 corresponding to the sheet ends ME in the width direction. In FIG. 3, the fifth head chip 20*e* faces one of the sheet ends ME and the fourteenth head chip 20*n* faces the other of the sheet ends ME. The fifth and the fourteenth head chips are the end head chips 20.

The end areas E are previously set from the sheet ends ME toward the both sides in the width direction. For example, each end area E extends over one or more head chip(s) 20 that is/are adjacent to the end head chip 20 facing the sheet end ME at both sides in the width direction. The adjacent head chips 20 are continuously aligned in the width direction from the end head chip 20 facing the sheet end ME. In each end area E of FIG. 3, a portion from the sheet end ME toward the center side in the width direction is larger than a portion from the sheet end ME toward the head end side.

In this case, the fourth head chip 20*d* adjacent to one head end side of the fifth head chip 20*e* and the sixth head chip 20*f* adjacent to a center side of the fifth head chip 20*e* are in the end area E. The fourth and the sixth head chips 20*d*, 20*f* are the end head chips 20. The thirteenth head chip 20*m* adjacent to a center side of the fourteenth head chip 20*n* and the fifteenth head chip 20*o* adjacent to the other head end of the fourth head chip 20*n* are in the end area E. The thirteenth and the fifteenth head chips 20*m*, 20*o* are the end head chips 20.

The facing head chip(s) 20 is one or more head chips 20 adjacent to one side of the end head chips 20 and facing the recording medium M. The head chips 20 adjacent to each other are continuously aligned in the width direction from said one side of the end head chips 20. For example, the facing head chip(s) 20 is/are disposed between the pair of end head chips 20 in the width direction. In FIG. 3, the seventh head chip 20*g* to the twelfth head chip 201 are adjacent to the center side of the sixth head chip 20*f* and the center side the thirteenth head chip 20*m*. The seventh head chip 20*g* to the twelfth head chip 201 are aligned continuously in the width direction to face the recording medium M.

The non-facing head chip(s) 20 is one or more head chips 20 adjacent to the other side of the end head chips 20 and not facing the recording medium M. The head chips 20 adjacent to each other are continuously aligned in the width direction from the other side of the end head chips 20. For example, the non-facing head chip(s) 20 is/are disposed at the head end side in the width direction of the pair of end head chips 20.

In FIG. 3, the first head chip 20*a* to the third head chip 20*c* are adjacent to one head end side of the fourth head chip 20*d*. The first head chip 20*a* to the third head chip 20*c* are continuously aligned from said one head end side of the fourth head chip 20*d*. The first head chip 20*a* to the third head chip 20*c* do not face the recording medium M. The sixteenth head chip 20*p* to the eighteenth head chip 20*r* are adjacent to the other head end side of the fifteenth head chip 20*o*. The sixteenth head chip 20*p* to the eighteenth head chip 20*r* are continuously aligned from the other head end side of the fifteenth head chip 20*o*. The sixteenth head chip 20*p* to the eighteenth head chip 20*r* do not face the recording medium M.

The positions of the head chips 20 with respect to the recording medium M as described above can be specified or identified by, for example, the setting data of the printing data. The positional relationship between the recording medium M and the discharge head 11*a* is specified by the size of the recording medium M in this setting data. The positions of the head chips 20 in the discharge head 11*a* are set in advance. Thus, the controller 62 determines the end head chips 20, the facing head chip(s) 20, and the non-facing head chip(s) 20 by the setting data.

As depicted in FIG. 7, the controller 62 makes the frequency of the non-discharge vibration drive by the actuators 30 in the facing head chips 20 larger than that in the non-facing head chips 20. The seventh head chip 20*g* to the twelfth head chip 201 that are the facing head chips 20 have the frequency level 2 or the frequency level 3. The first head chip 20*a* to the third head chip 20*c* and the sixteenth head chip 20*p* to the eighteenth head chip 20*r* that are the non-facing head chips 20 have the frequency level 1.

Thus, in the facing head chips 20 in which ink is easily dried due to the air current caused by the conveyance of the recording medium M, a larger number of times of non-discharge vibration drive than that in the non-facing head chips 20 is executed by the actuators 30. Even when ink in the nozzles 21 is dried and thickened, thickened ink is diffused and the viscosity of ink is decreased by vibrating the meniscus of the nozzles 21 corresponding to the actuators 30. This inhibits the decrease in image quality.

In the non-facing head chips 20 in which ink is not likely to be dried thanks to a small effect of the air current, the frequency of non-discharge vibration drive is smaller that in the facing head chips 20. This reduces the number of times of drive of the actuators 30, which reduces power consumption and heat generation for maintenance.

As depicted in FIG. 7, the controller 62 makes the circulation flowing amount of ink in the circulation channels 33, 34 in the facing head chips 20 larger than that in the non-facing head chips 20. In the example of FIG. 3, the seventh head chip 20*g* to the twelfth head chip 201 that are the facing head chips 20 have a flowing amount level 2. On the other hand, the first head chip 20*a* to the third head chip 20*c* and the sixteenth head chip 20*p* to the eighteenth head chip 20*r* that are the non-facing chips 20 have a flow amount level 1.

The circulation flowing amount is set to be larger, as the flowing amount level is higher. This correspondence relationship is set in advance. The controller 62 controls the positive pressure pump 27 and the negative pressure pump 28 so that the flowing amount in the circulation channels 33, 34 is equal to this circulation flowing amount.

Accordingly, the circulation flowing amount in the facing head chip(s) 20 in which ink is easily dried by air current is larger than that in the non-facing head chip(s) 20. Thus, circulating the thickened ink in the facing head chip(s) 20 through the circulation channels 33, 34 inhibits the increase in ink viscosity and deterioration in image quality.

In the non-facing head chip(s) 20 that has/have a small effect of the air current and in which ink is not likely to be dried, the circulation flowing amount is small. This reduces power consumption and heat generation required for the pumps.

Accordingly, the controller 62 controls the circulation flowing amount by the setting data. Namely, the controller 62 controls each pump such that the circulation flowing amount of ink in the circulation channels 33, 34 in each of head chips 20 is changed depending on the size in the width direction of the recording medium M. Accordingly, the circulation flowing amount can be controlled easily.

<Liquid Discharge Method>

A liquid discharge method according to the first embodiment is performed by the controller 62. The controller 62 executes a computer program for operating the liquid discharge apparatus 10 in accordance with a flowchart in FIG. 9.

The controller 62 obtains printing data (step S10), generates dot data from image data of the printing data, and outputs the dot data to the actuator drive circuit 17 (step S11). The controller 62 determines from setting data of the printing data whether each head chip 20 of each discharge head 11*a* is any of the end head chip 20, the facing head chip 20, and the non-facing head chip 20 (steps S12, S13).

The controller 62 selects the flowing amount level 1 (step S14) and the frequency level 1 (step S15) for the head chip(s) 20 determined as the non-facing head chip(s) 20 (step S12: YES). On the other hand, the controller 62 selects the flowing amount level 2 (step S16) and the frequency level 2 (step S17) for the head chip(s) 20 determined as the facing head chip(s) 2C) (step S12: NO, step S13: YES).

The controller 62 outputs the circulation flowing amount of the selected flowing amount level to the pump drive circuit 18. The pump drive circuit 18 controls the positive pressure pump 27 and the negative pressure pump 28 so that the flowing amount in the circulation channels 33, 34 is equal to the circulation flowing amount of the selected flowing amount level. This makes the circulation flowing amount of the ink in the circulation channels 33, 34 in the facing head chip(s) 20 larger than that in the non-facing head chip(s) 20.

Thus, even when air current is caused by the conveyance of the recording medium M and ink is thickened in the facing head chip(s) 20 in which ink is easily dried by the air current, the thickened ink is circulated. This reduces the viscosity of ink and inhibits deterioration image quality. On the other hand, in the non-facing head chip(s) 20 in which ink is not likely to be dried by the air current, it is possible to reduce power consumption and heat generation required for the circulation by making the circulation flowing amount therein smaller than that in the facing head chip(s) 20.

The controller 62 generates selection data for selecting an operation pattern of the selected frequency level and outputs the selection data to the actuator drive circuit 17, The actuator drive circuit 17 generates discharge drive data depending on the dot data and non-discharge vibration drive data corresponding to the operation pattern selected by the selection data. The controller 62 combines the discharge drive data and the non-discharge vibration drive data, thus generating drive data for driving the actuator 30 (step S18). The waveform generating circuit 17*a* generates a drive signal based on the drive data, and supplies the drive signal to the actuator 30. The actuator 30 is driven by the drive signal.

The actuator 30 executes a larger number of times of non-discharge vibration drive in the facing head chip(s) 20 than in the non-facing head chip(s) 20. This vibrates the meniscuses of the nozzles 21 in the facing head chip(s) 20 in which ink is easily dried, thus diffusing the thickened ink and decreasing the viscosity of ink. Accordingly, deterioration in image quality is inhibited. On the other hand, the actuator 30 executes a smaller number of times of non-discharge vibration drive in the non-facing head chip(s) 20, in which ink is not likely to be dried, than in the facing head chip(s) 20. This reduces power consumption and heat generation required for the non-discharge vibration drive.

Figure 9:
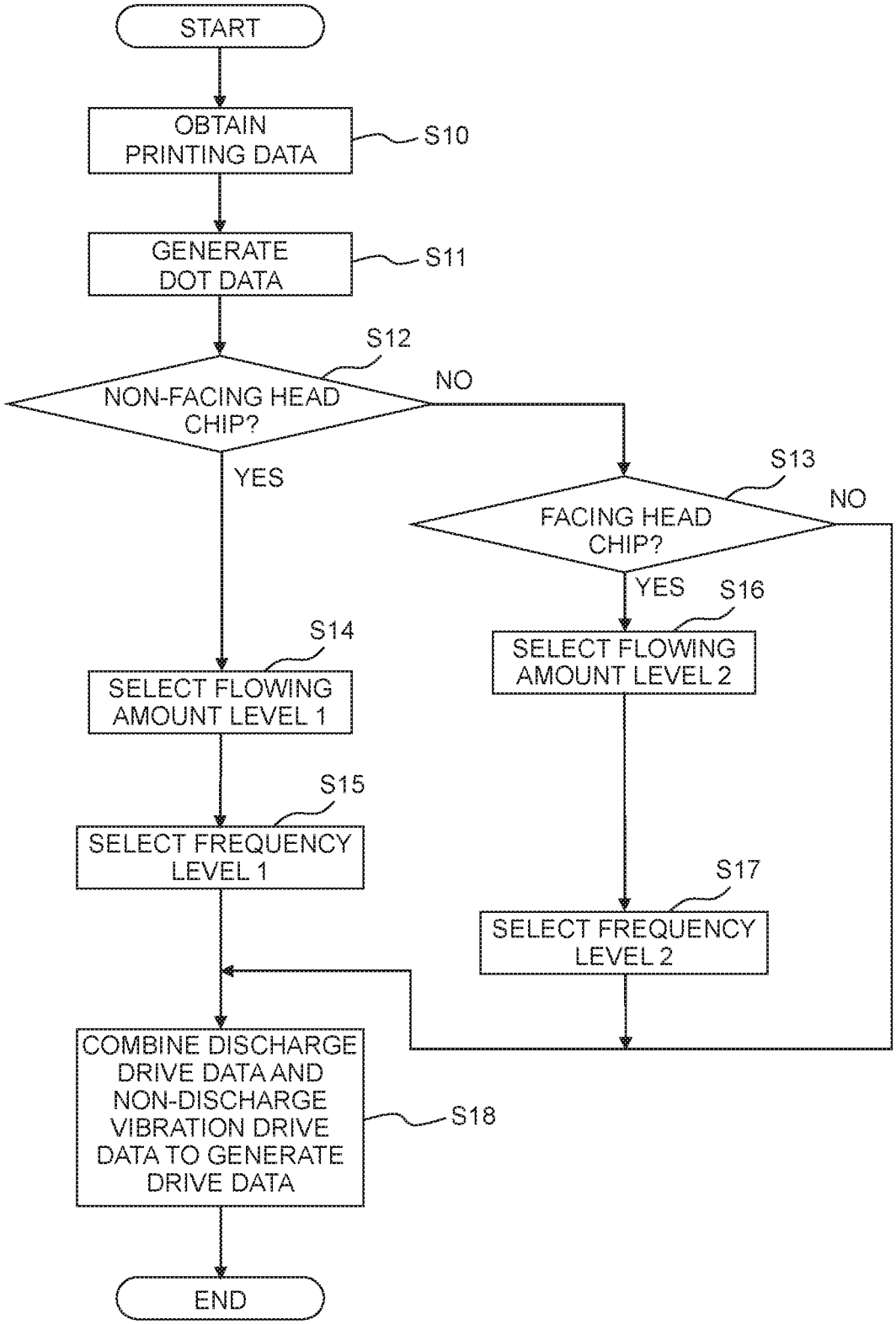
FIG. 9 is a flowchart indicating an exemplary liquid discharge method by the liquid discharge apparatus in FIG. 1.

In the flowchart of FIG. 9, both the circulation flowing amount of ink in the circulation channels 33, 34 and the frequency of the non-discharge vibration drive by the actuator 30 in the facing head chip(s) 20 are larger than those in the non-facing head chip(s) 20. However, the circulation flowing amount in the facing head chip(s) 20 may be equal to that in the non-facing head chip(s) 20, and the frequency of the non-discharge vibration drive in the facing head chip(s) 20 may be larger than that in the non-facing head chip(s) 20. Further, the frequency of the non-discharge vibration drive in the facing head chip(s) 20 may be equal to that in the non-facing head chip(s) 20, and the circulation flowing amount in the facing head chip(s) 20 may be larger than that in the non-facing head chip(s) 20.

First Modified Embodiment

In a liquid discharge apparatus 10 according to the first modified embodiment, the controller 62 makes at least one of the circulation flowing amount of ink and the frequency of the non-discharge vibration drive in the end head chips 20 larger than those in the facing head chip(s) 20 and the non-facing head chip(s) 20.

Figure 10:
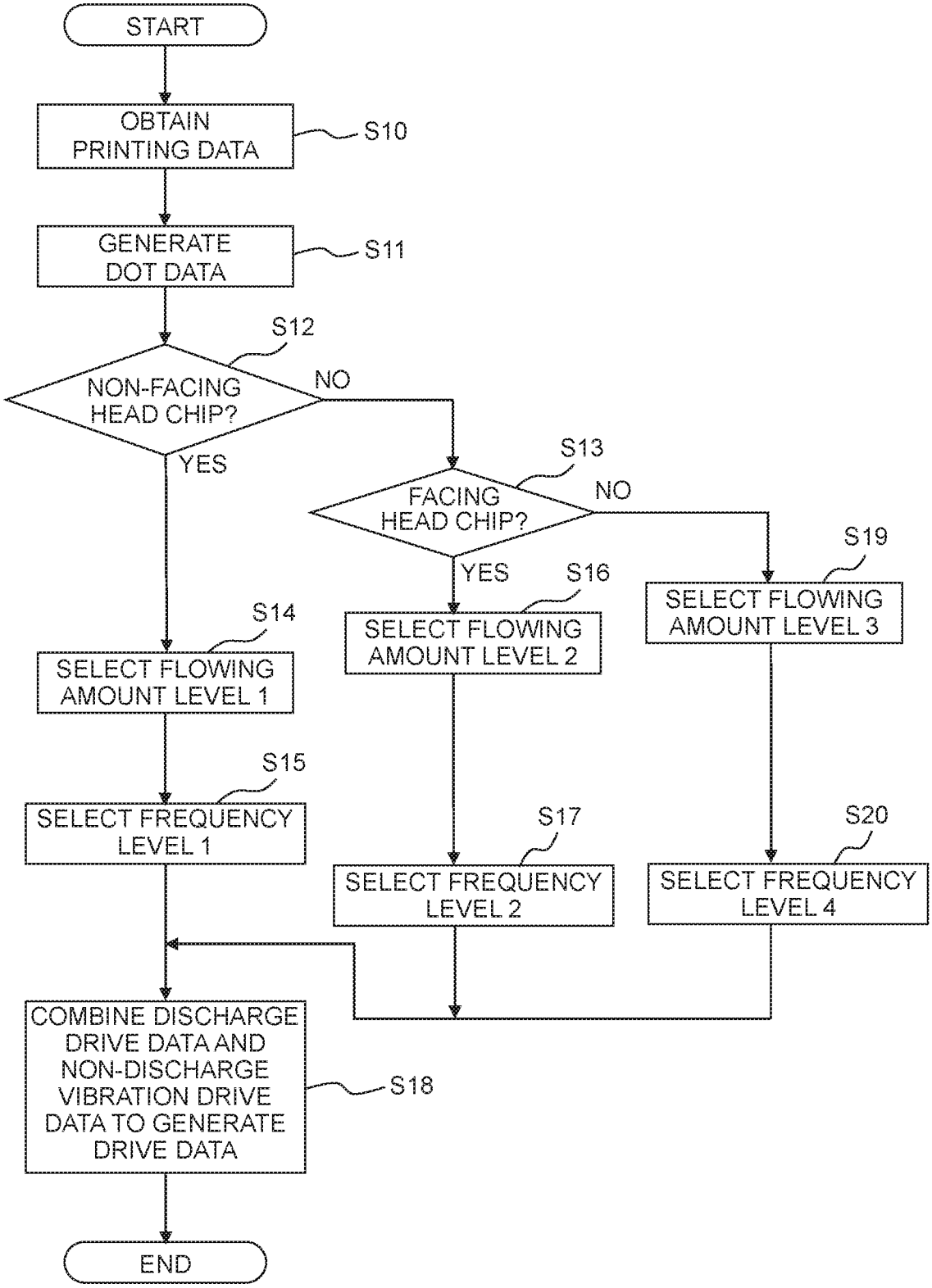
FIG. 10 is a flowchart indicating an exemplary liquid discharge method by a liquid discharge apparatus according to the first modified embodiment.

For example, as indicated in FIG. 10, the processes in the steps S19 and S20 are executed between the step S13: NO and the step S18 in FIG. 9.

Specifically, the controller 62 selects the flowing amount level 3 (step S19) and the frequency level 4 (step S20) for the head chips 20 determined as the end head chips 20 (step S12:NO, S13: NO). Then, the controller 62 outputs the circulation flowing amount of the selected flowing amount level to the pump drive circuit 18, generates the selection data for selecting the operation pattern of the selected frequency level, and outputs the selection data to the actuator drive circuit 17.

Accordingly, the circulation flowing amount and the frequency of non-discharge vibration drive in the end head chips 20 are larger than those in the facing head chip(s) 20 and the non-facing head chip(s) 20. The air current in the end head chips 20 is faster than that in the facing head chip(s) 20 and the non-facing head chip(s) 20 and thus ink easily dries in the end head chips 20. In order to solve this problem, in the end head chips 20, the thickened ink due to drying is diffused by increasing the circulation flowing amount and the frequency of non-discharge vibration drive. This decreases the viscosity of ink and inhibits the deterioration image quality.

On the other hand, in the facing head chip(s) 20 and the non-facing head chip(s) 20 in which ink is less likely to be dried by the air current than the end head chips 20, the circulation flowing amount and the frequency of non-discharge vibration drive are reduced. This decreases the power consumption and heat generation required for the circulation and the non-discharge vibration drive.

In a flowchart of FIG. 10, both the circulation flowing amount of ink in the circulation channels 33, 34 and the frequency of non-discharge vibration drive by the actuator 30 in the end head chips 20 are larger than those in the facing head chip(s) 20 and the non-facing head chip(s) 20. However, the circulation flowing amount in the end head chips 20 may be equal to that in the facing head chip(s) 20 and the non-facing head chip(s) 20, and the frequency of the non-discharge vibration drive in the end head chips 20 may be larger than those in the facing head chip(s) 20 and the non-facing head chip(s) 20. Further, the frequency of the non-discharge vibration drive in the end head chips 20 may be equal to that in the facing head chip(s) 20 and the non-facing head chip(s) 20. The circulation flowing amount in the end head chips 20 may be larger than those in the facing head chip(s) 20 and the non-facing head chip(s) 20.

Second Modified Embodiment

In a liquid discharge apparatus 10 according to the second modified embodiment, the nozzle group of each end head chip 20 includes facing end nozzle(s) 21 facing the recording medium M, and non-facing end nozzle(s) 21 not facing the recording medium M. The controller 62 makes the frequency of non-discharge vibration drive for the facing end nozzle(s) 21 larger than the frequency of non-discharge vibration drive for the non-facing end nozzle(s) 21.

For example, in FIG. 3, the fourth head chip 20*d* to the sixth head chip 20*f* and thirteenth head chip 20*m* to the fifteenth head chip 20*o* correspond to the end head chips 20. Among those, the nozzle groups in the fifth head chip 20*e* to the sixth head chip 20*f* and the thirteenth head chip 20*m* to the fourteenth head chip 20*n* are positioned at the center side of the sheet ends ME to face the recording medium M. Thus, all the nozzles 21 belonging to those nozzle groups correspond to the facing end nozzles 21.

The nozzle group of the fourth head chip 20*d* is positioned at one head end side of the sheet end ME, and the nozzle group of the fifteenth head chip 20*o* is positioned at the other head end side of the sheet end ME. Those nozzle groups thus do not face the recording medium M. All the nozzles 21 belonging to those nozzle groups correspond to the non-facing end nozzles 21.

As depicted in FIG. 7, the non-facing end nozzles 21 included in the fourth head chip 20*d* and the fifteenth head chip 20*o* that are the end head chips 20 have the frequency level 3, and the facing end nozzles 21 included in the fifth head chip 20*e* to the sixth head chip 20*f* and the thirteenth head chip 20*m* to the fourteenth head chip 20*n* have the frequency level 4 or the frequency level 5. Thus, the frequency of the non-discharge vibration drive in the facing end nozzles 21 is larger than that in the non-facing end heads 21.

In the above configuration, the air current in the facing end nozzles 21 is faster than that in the non-facing end nozzles 21, and thus the ink in the facing end nozzles 21 easily dries. Increasing the frequency of non-discharge vibration drive in the facing end nozzles 21 diffuses thickened ink and inhibits deterioration in image quality. Further, decreasing the frequency of non-discharge vibration drive in the non-facing end nozzles 21, in which ink is not likely to dry, reduces the power consumption and heat generation in the actuators 30.

In the example of FIG. 3, all the nozzles 21 belonging to the nozzle groups provided in the fifth head chip 20*e* and the fourteenth head chip 20*n* facing the sheet ends ME face the recording medium M. Thus, all the nozzles 21 belonging to those nozzle groups are determined as the facing end nozzles 21. However, when some of the nozzles 21 belonging to each of the nozzle groups face the recording medium M, said some of the nozzles 21 are determined as the facing end nozzles 21. Thus, one nozzle group includes the facing end nozzles 21 at the center side of the sheet end ME in the width direction, and the non-facing end nozzles 21 at the head end side of the sheet end ME in the width direction.

In this case, the controller 62 makes the circulation flowing amount of ink of the facing end nozzles 21 equal to the circulation flowing amount of ink of the non-facing end nozzles 21, the facing end nozzles 21 and the non-facing end nozzles 21 being included in the nozzle group of the same end head chip 20. In this configuration, the circulation flowing amount of ink can be controlled for each head chip 20, which inhibits a cost rise without increasing the parts, such as a pump, for adjusting the circulation flowing amount.

Third Modified Embodiment

In a liquid discharge apparatus 10 according to the third modified embodiment, the controller 62 increases the frequency of non-discharge vibration drive as a discharge duty of ink from the nozzle is lower. The discharge duty is a ratio of the number of times ink is discharged from the nozzle 21 in the printing process or the pass process. For example, the discharge duty is a ratio of the number of drive cycles of the discharge drive in a predefined number of drive cycles.

For example, in FIG. 6A, the number of drive cycles of the discharge drive in the first to the nineteenth drive cycles is 0 in the first actuator 30, is 4 in the second actuator 30, and is 8 in the third actuator 30. Thus, the discharge duty of the first actuator 30 is 0 (=0/19), the discharge duty of the second actuator 30 is 4/19, and the discharge duty of the third actuator 30 is 8/19.

In FIG. 7, the frequency level in the nozzle 21 having a discharge duty of equal to or more than a predefined value (high duty) is set to be larger than that in the nozzle 21 having a discharge duty of less than the predefined value (low duty). Here, in the facing head chip(s) 20, the frequency level of the high duty is 2, and the frequency level of the low duty is 3. Further, in the end head chips 20, the frequency level of the high duty in the actuators 30 corresponding to the facing end nozzles 21 is 4, and the frequency level of the low duty therein is 5.

As described above, the smaller the discharge duty, the less the ink discharged from the nozzle 21. This easily causes the drying of the nozzle 21, resulting in the increase in viscosity of ink. Thus, the thickened ink is diffused by increasing the frequency of the non-discharge vibration drive for the actuator 30 that corresponds to the nozzle 21 with the low duty, thereby inhibiting the deterioration in image quality owing to the thickened ink.

Figure 11A:
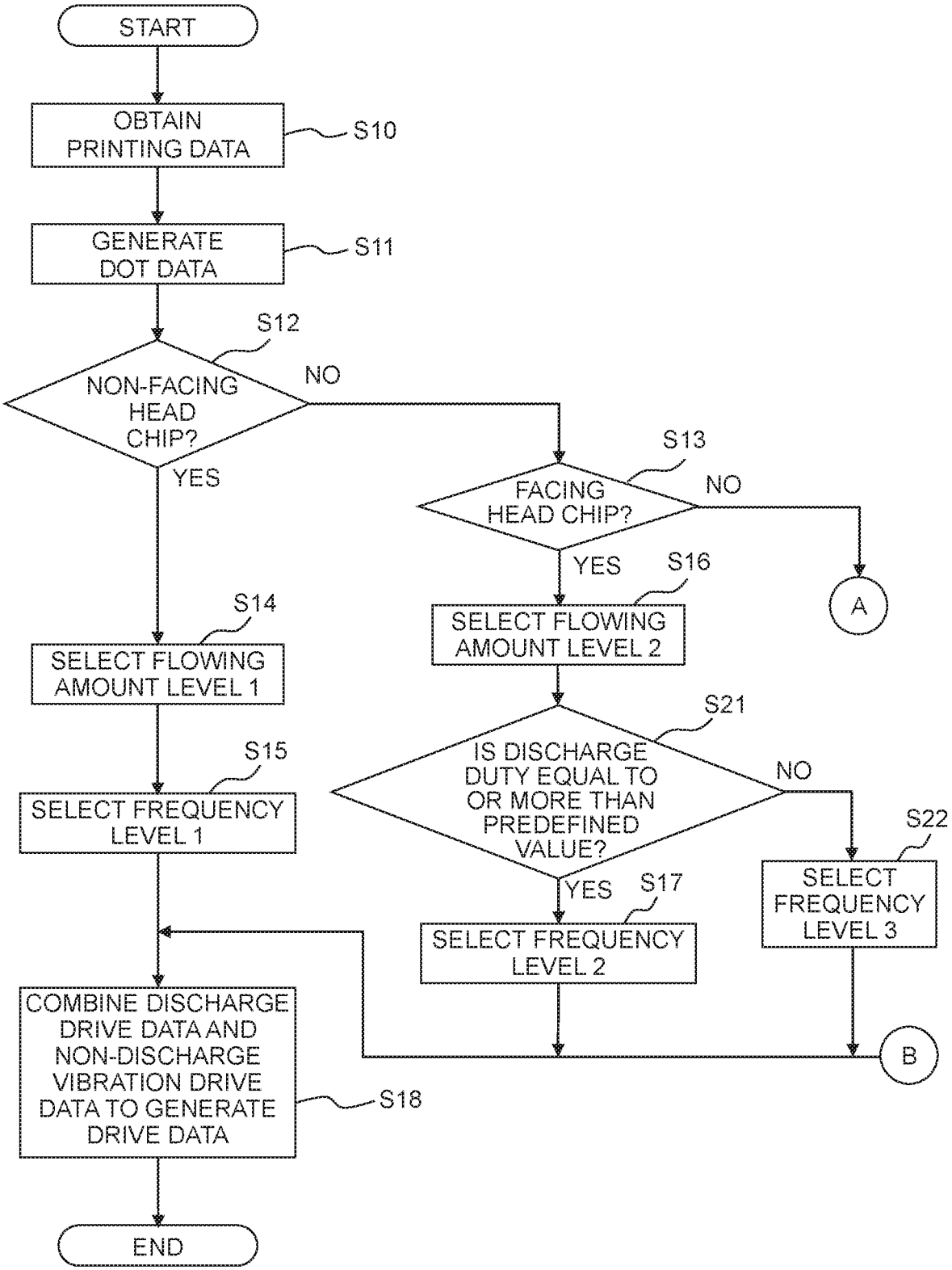
FIGS. 11A and 11B depict a flowchart indicating an exemplary liquid discharge method by a liquid discharge apparatus according to the second modified embodiment.
Figure 11B:
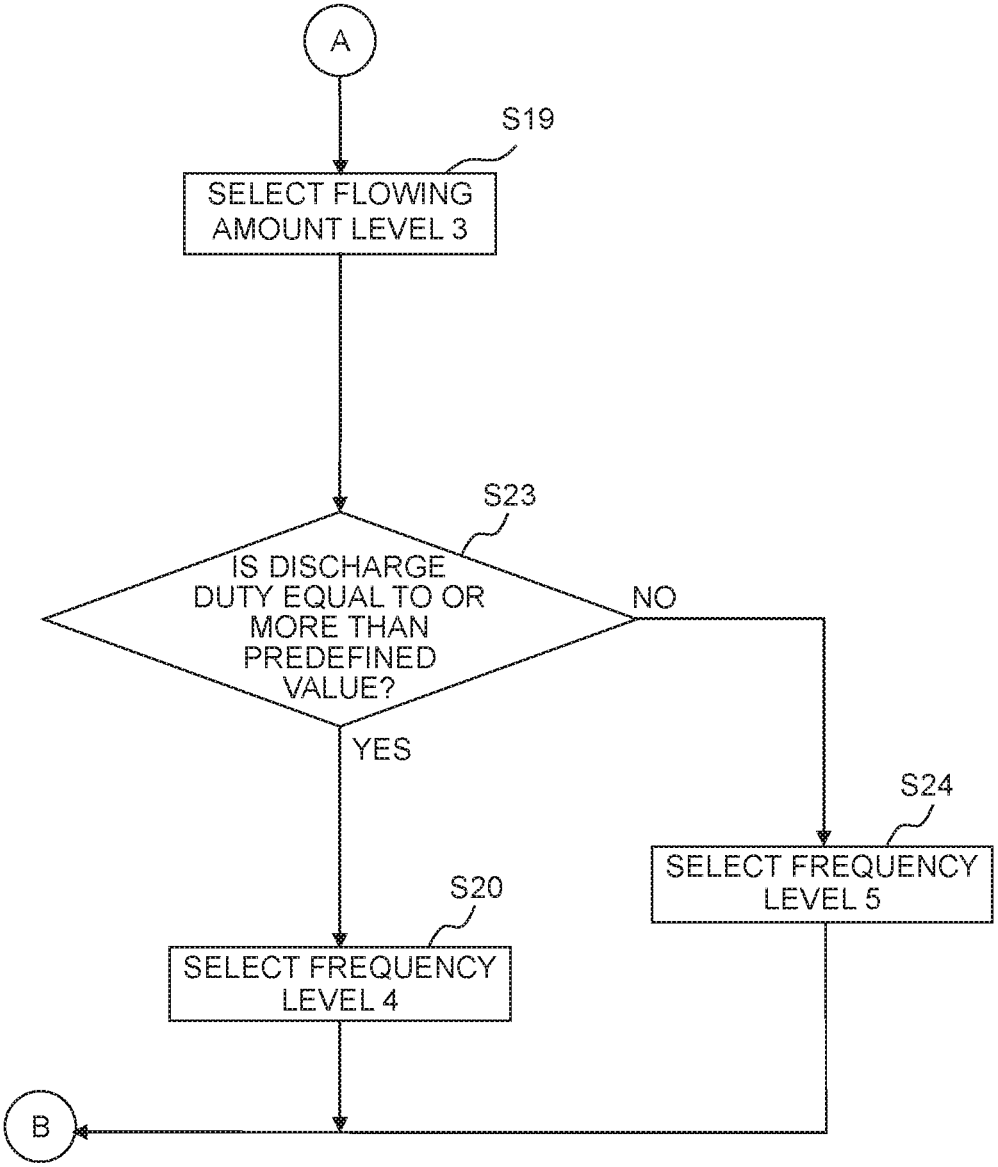

Thus, in the liquid discharge method, the processes of steps S21 to S22 are executed between the step S16 and the step S18 in FIG. 10, and the processes of steps S23 to S24 are executed between the step S19 and the step S18 in FIG. 10, as indicated in FIGS. 11A and 11B.

Specifically, the controller 62 specifies, from the clot data, the discharge duty of the nozzle 21 in the head chip 20 that has been determined as the facing head chip 20 (step S12: NO, S13: YES), and determines whether the discharge duty is equal to or more than the predefined value (step S21). The controller 62 selects the frequency level 2 (step S17) for the actuator 30 corresponding to the high duty nozzle 21 with equal to or more than the predefined value (step S21: YES), and selects the frequency level 3 (step S22) for the actuator 30 corresponding to the low duty nozzle 21 with less than the predefined value (step S21: NO).

Further, the controller 62 specifies, from the dot data, the discharge duty of the nozzle 21 in the head chip 20 that has been determined as the end head chip 20 (step S12: NO, S13: NO), and determines whether the discharge duty is equal to or more than the predefined value (step S23). The controller 62 selects the frequency level 4 (step S20) for the actuator 30 corresponding to the high duty nozzle 21 with equal to or more than the predefined value (step S23: YES), and selects the frequency level 5 (step S24) for the actuator 30 corresponding to the low duty nozzle 21 with less than the predefined value (step S23: NO).

Second Embodiment

Figure 12:
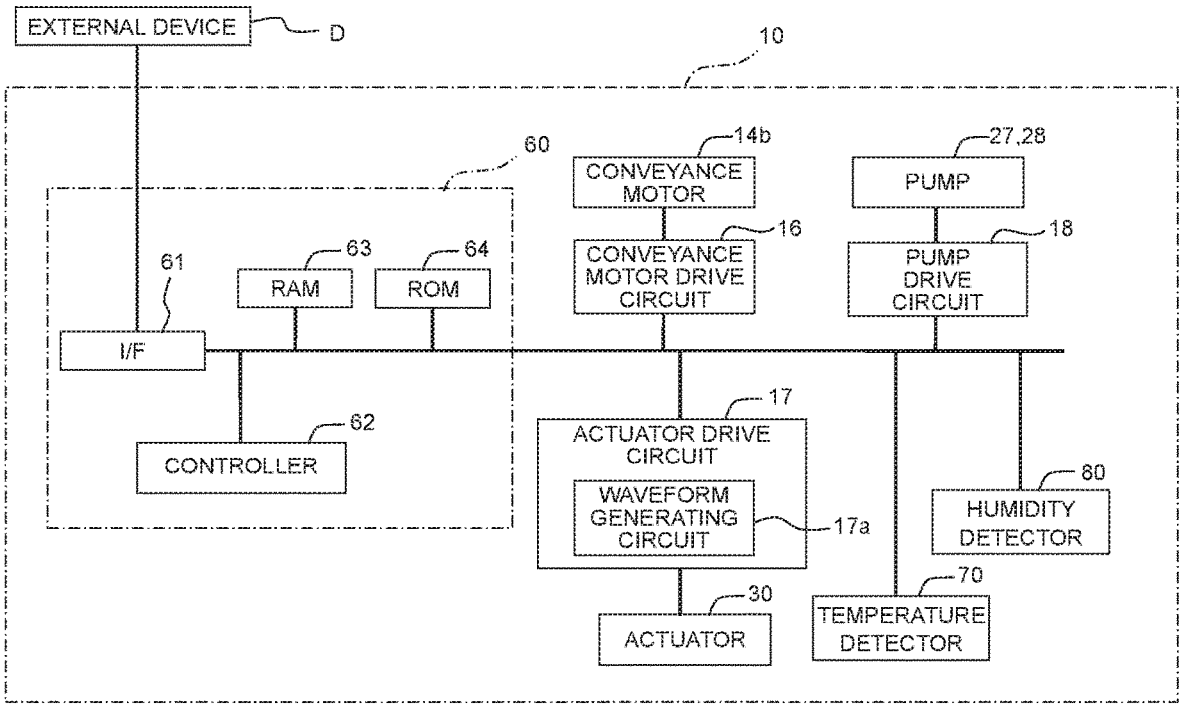
FIG. 12 is a block diagram indicating a functional configuration of a liquid discharge apparatus according to the second embodiment of the present disclosure.

As depicted in FIG. 12, a liquid discharge apparatus 10 according to the second embodiment includes a temperature sensor 70 that detects a temperature in the liquid discharge apparatus 10, Any other configurations than the temperature sensor 70 are similar to those in the first embodiment, the explanation therefor is omitted.

The temperature sensor 70 is a sensor that detects a temperature of air contacting with the meniscuses of the ink formed in the nozzle holes 21*a* of the head chips 20. For example, the temperature sensor 70 is provided in the discharge head 11*a* in the liquid discharge apparatus 10. The temperature sensor 70 detects a temperature around the discharge head 11*a* that is a temperature in the liquid discharge apparatus 10. The detected temperature may be corrected based on a predefined correspondence relationship between the detected temperature and a temperature in the vicinity of the nozzle holes 21*a*.

When the detected temperature detected by the temperature sensor 70 is equal to or more than the first predefined temperature in at least one of the end head chips 20, the facing head chip(s) 20, and the non-facing head chip(s) 20, the controller 62 selects an operation pattern. The frequency of the operation pattern is smaller than a case where the detected temperature is less than the first predefined temperature. When the detected temperature detected by the temperature sensor 70 is less than the second predefined temperature, which is lower than the first predefined temperature, in at least one of the end head chips 20, the facing head chip(s) 20, and the non-facing head chip(s) 20, the controller 62 selects an operation pattern. The frequency of the operation pattern is smaller as the detected temperature is higher.

For example, a correspondence relationship table between temperatures and shift amounts indicated in FIG. 13 is used. The shift amounts are change amounts from a predefined correspondence relationship between positions of the head chips 20 with respect to the recording medium M and the frequency levels of non-discharge vibration drive indicated in FIG. 7. Each Plus sign used for the shift amount indicates an increase in frequency level, each minus sign used for the shift amount indicates a decrease in frequency level, and each numerical value indicated in the shift amount indicates a degree of change. The shift amount having the plus sign is used when the frequency level is increased, and the shift amount having the minus sign is used when the frequency level is decreased.

When the detected temperature detected by the temperature sensor 70 is equal to or more than 15° C. and less than 35° C. the shift amount is set to zero. In such a temperature range that is normal temperature (predefined temperature range), the meniscuses of the nozzle holes 21*a* are not likely to dry, so that a predefined frequency level corresponding to a position with respect to the recording medium M is set without changing the predefined correspondence relationship in FIG. 7.

On the other hand, the detected temperature may be higher than the predefined temperature range. In that case, the shift amount is set to −1 when the temperature is equal to or more than 35° C. and less than 40° C., and the shift amount is set to −2 when the detected temperature is equal to or more than 40° C. Accordingly, the frequency level is lowered as the temperature is higher.

As described above, when the detected temperature is equal to or more than the first predefined temperature (e.g., 35° C.), an operation pattern having a smaller frequency of the non-discharge vibration drive than a case where the detected temperature is less than the first predefined temperature, is selected. Thus, in a high temperature environment where the detected temperature is equal to or more than the first predefined temperature, the frequency of the non-discharge vibration drive is reduced as the detected temperature is higher. This decreases the heat generation by the non-discharge vibration drive.

The detected temperature may be lower than the predefined temperature range. In that case, the shift amount is set to +1 when the detected temperature is equal to or more than 10° C. and less than 15° C., and the shift amount is set to +2 when the detected temperature is less than 10° C. The frequency level is increased as the detected temperature is lower.

As described above, when the detected temperature is less than the second predefined temperature (e.g., 15° C.), an operation pattern of which frequency is smaller as the detected temperature is higher, is selected. Thus, in a low temperature environment of less than the second predefined temperature, the frequency of the non-discharge vibration drive is reduced as the detected temperature is higher. This reduces the power consumption by the non-discharge vibration drive.

Third Embodiment

As depicted in FIG. 12, a liquid discharge apparatus 10 according to the third embodiment includes a humidity sensor 80 that detects humidity in the liquid discharge apparatus 10. Any other configurations than the humidity sensor 80 are similar to those in the first embodiment, the explanation therefor is omitted.

The humidity sensor 80 is a sensor that detects humidity of air contacting with the meniscuses of the ink formed in the nozzle holes 21*a* of the head chips 20. For example, the humidity sensor 80 is provided in the discharge head 11*a* in the liquid discharge apparatus 10. The humidity sensor 80 detects humidity around the discharge head 11*a* that is humidity in the liquid discharge apparatus 10. The detected humidity may be corrected based on a predefined correspondence relationship between the detected humidity and humidity in the vicinity of the nozzle holes 21*a*.

When the detected humidity detected by the humidity sensor 80 is equal to or more than the first predefined humidity in at least one of the end head chips 20, the facing head chip(s) 20, and the non-facing head chip(s) 20, the controller 62 selects an operation pattern of which frequency is smaller than a case where the detected humidity is less than the first predefined humidity.

For example, a correspondence relationship table between humidity and shift amounts indicated in FIG. 14 is used. The shift amounts are similar to those in FIG. 13. The shift amount is set to zero when the detected humidity detected by the humidity sensor 80 is equal to or more than 40% and less than 60%. In such a humidity range that is normal humidity (predefined humidity range), a predefined frequency level corresponding to a position with respect to the recording medium M is set without changing the predefined correspondence relationship in FIG. 7.

On the other hand, the detected humidity may be higher than the predefined humidity range. In that case, the shift amount is set to −1 when the detected humidity is equal to or more than 60% and less than 70%. The shift amount is set to −2 when the detected humidity is equal to or more than 70%. As described above, the frequency level is lowered as the humidity is higher.

As described above, when the detected humidity is equal to or more than the first predefined humidity (e.g., 60%), the meniscuses of the nozzle holes 21*a* are not likely to dry. Thus, the operation pattern of which frequency is smaller than the case where the detected humidity is less than the first predefined humidity, is selected. Accordingly, in a high humidity environment of equal to or more than the first predefined humidity, the frequency of non-discharge vibration drive is reduced as the detected humidity is higher. This reduces the power consumption and heat generation by the non-discharge vibration drive.

The detected humidity may be lower than the predefined humidity range. In that case, the shift amount is set to +1 when the humidity is equal to or more than 30% and less than 40%. The shift amount is set to +2 when the humidity is less than 30%. Accordingly, the frequency level is increased as the humidity is lower.

As described above, when the detected humidity is less than the second predefined humidity (e.g., 30%) that is lower than the first predefined humidity, an operation pattern of which frequency is larger as the detected humidity is lower, is selected. Thus, in a low humidity environment where ink easily dries, the deterioration in image quality due to the increase in viscosity of ink droplets can be inhibited by increasing the frequency of output of the non-discharge drive signal and inhibiting the drying of ink.

Fourth Embodiment

Figure 15:
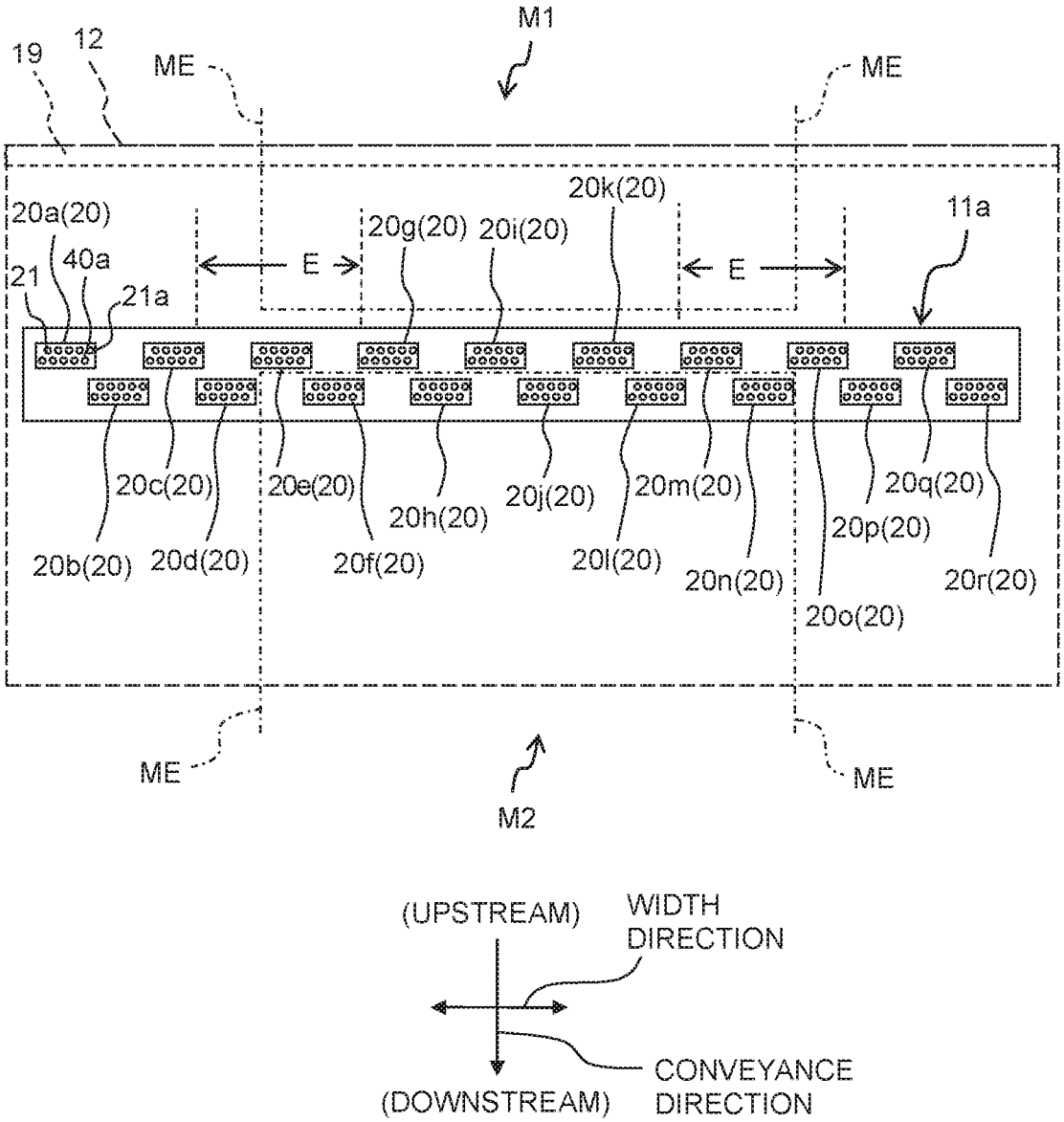
FIG. 15 depicts a discharge head of a liquid discharge apparatus according to the third embodiment of the present disclosure, when seem from a discharge surface side.

As depicted in FIG. 15, a liquid discharge apparatus 10 according to the fourth embodiment uses a cut sheet as the recording medium M. The controller 62 makes the frequency of the non-discharge vibration drive in the nozzle(s) 21 facing a portion between a preceding cut sheet and a succeeding cut sheet conveyed next to the preceding cut sheet, smaller than that in the nozzle(s) 21 facing the cut sheet.

Figure 16:
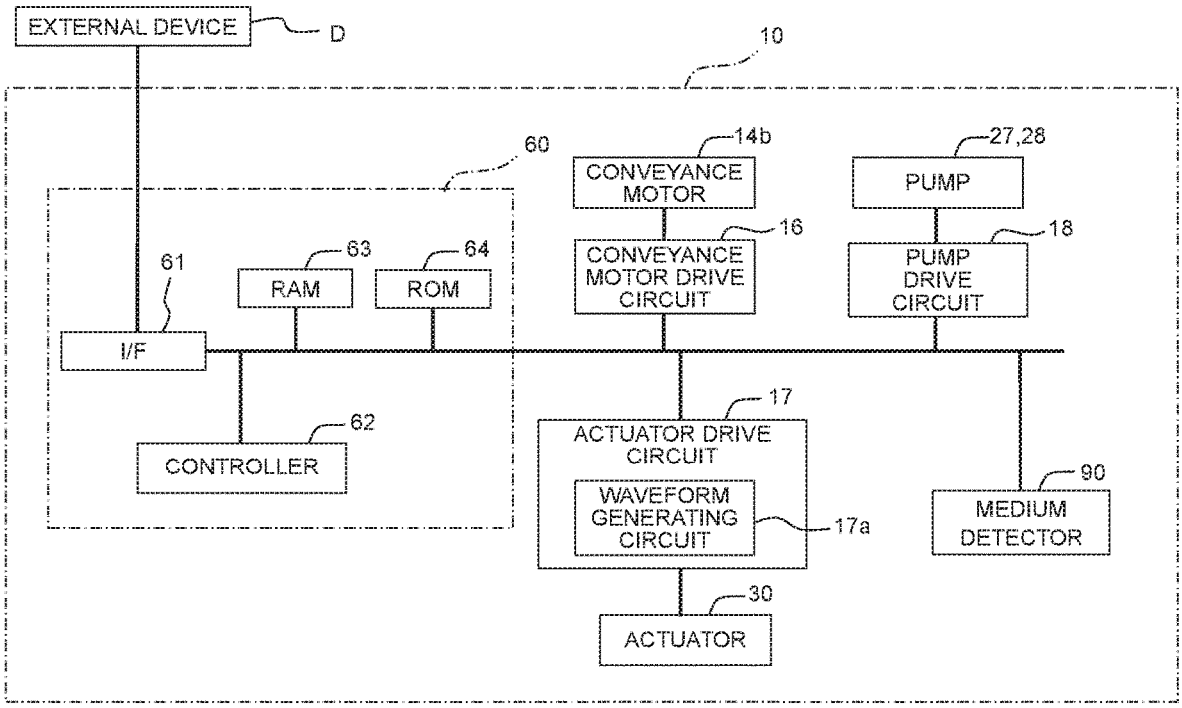
FIG. 16 is a block diagram depicting a functional configuration of the liquid discharge apparatus in FIG. 15.

Specifically, as depicted in FIG. 16, the liquid discharge apparatus 10 includes a medium detecting portion 90 that detects the recording medium M. The medium detecting portion 90 is disposed, for example, in a predefined position such as the vicinity of the conveyance roller 14*a* (FIG. 1). The medium detecting portion 90 detects the recording medium M and outputs a detection signal to the controller 62. Accordingly, the controller 62 specifies the size of the recording medium M, and determines the positional relationship between the recording medium M and the head chips 20.

As depicted in FIG. 15, the cut sheet is a sheet cut into a predefined size in the conveyance direction. The cut sheet is set between the platen 12 and a sheet holder 19. The sheet holder 19 is disposed above the platen 12 at an upstream side of the discharge head 11*a* in the conveyance direction with a spacing distance between the sheet holder 19 and the platen 12. The sheet holder 19 is disposed parallel to the platen 12.

In the discharge head 11*a*, the first, third, fifth, seventh, ninth, eleventh, thirteenth, fifteenth, and seventeenth head chips 20 are aligned in the width direction to form an upstream-side head chip row. Further, the second, fourth, sixth, eighth, tenth, twelfth, fourteenth, sixteenth, and eighteenth head chips 20 are aligned in the width direction to form a downstream-side head chip row. The upstream-side head chip row is disposed upstream of the downstream-side head chip row in the conveyance direction.

In the conveyance direction, a downstream end of the cut sheet conveyed first (preceding cut sheet M1) is positioned between the upstream-side head chip row and the downstream-side head chip row. An upstream end of the cut sheet conveyed next to the preceding cut sheet M1 (succeeding cut sheet M2) is disposed upstream of the upstream-side head chip row.

In this case, the sixth, eighth, tenth, twelfth, fourteenth head chips 20 (the sixth to the fourteenth head chips 20) belonging to the downstream-side head chip row face the preceding cut sheet M1. The fifth, seventh, ninth, eleventh, and thirteenth head chips 20 (the fifth to the thirteenth head chips 20) belonging to the upstream-side head chip row face a portion between the preceding cut sheet M and the succeeding cut sheet M2. Namely, the fifth, seventh, ninth, eleventh, and thirteenth head chips 20 face no cut sheet.

Thus, the controller 62 determines the position of the head chips 20 with respect to the cut sheet based on a detection position from the medium detecting portion 90. The controller 62 makes the frequency of the non-discharge vibration drive in the fifth to the thirteenth head chips 20 smaller than that in the sixth to the fourteenth head chips 20. Reducing the frequency of the non-discharge vibration drive as described above makes it possible to reduce the power consumption and heat generation by the non-discharge vibration drive.

On the other hand, the controller 62 may make the circulation flowing amount of the ink in the fifth to the thirteen head chips 20 equal to that in the sixth to the fourteenth head chips 20. Namely, the state where the fifth to the thirteenth head chips 20 face the preceding cut sheet M1 is changed to the state where the fifth to the thirteenth head chips 20 do not face the preceding cut sheet M1 and are positioned between the preceding cut sheet M1 and the succeeding cut sheet M2 by moving the preceding cut sheet M1 in the conveyance direction. The state where the fifth to the thirteenth head chips 20 are positioned between the preceding cut sheet M1 and the succeeding cut sheet M2 is changed to the state where the fifth to the thirteenth head chips 20 face the succeeding cut sheet M2 by moving the succeeding cut sheet M2 in the conveyance direction.

As described above, the state of the fifth to the thirteenth head chips 20 is changed between a facing state where the fifth to the thirteenth head chips 20 face the cut sheet and a non-facing state where the fifth to the thirteenth head chips 20 do not face the cut sheet by the movement of the cut sheet. In this configuration, since an interval between the preceding cut sheet M1 and the succeeding cut sheet M is short, the circulation flowing amount in the fifth to the thirteenth head chips 20 having the non-facing state is not changed. This can inhibit the decrease in power consumption that may otherwise be caused by the change in the circulation flowing amount.

Other Embodiments

As described in FIG. 5, the liquid discharge apparatuses 10 in all the embodiments each have the positive pressure pump 27 and the negative pressure pump 28, and the circulation flowing amount is controlled thereby. The control of the circulation flowing amount, however, is not limited thereto.

Figure 17:
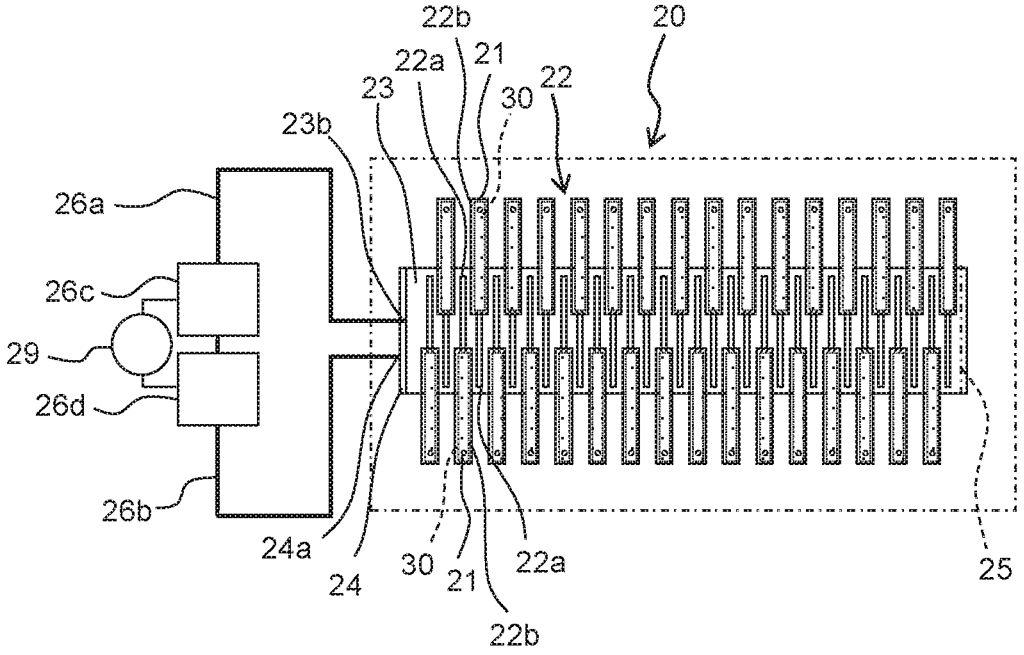
FIG. 17 schematically depicts a head chip and a subtank of a liquid discharge apparatus according to another embodiment.

For example, as depicted in FIG. 17, the first subtank 26*c* is connected to the supply opening 23*a* of the head chip 20 via the supply channel 26*a*, the second subtank 26*d* is connected to the return opening 24*a* of the head chip 20 via the return channel 26*b*, and the first subtank 26*c* is connected to the second subtank 26*d* via a connection channel 26*e*. A pressure adjuster 29 is connected to the first subtank 26*c* and the second subtank 26*d*. The pressure adjuster 29 is, for example, a pump. The controller 62 controls and adjusts the pressure of the first subtank 26*c* and the second subtank 26*d*.

The controller 62 makes the pressure of the first subtank 26*c* higher than the pressure of the second subtonic 26*d* so that ink is inhibited from flowing from the first subtank 26*c* to the second subtank 26*d* via the connection channel 26*e*. In this configuration, ink circulates as follows: ink is supplied from the first subtank 26*c* to the supply manifold 23, returns from the return manifold 24 to the second subtank 26*d*, and flows to the first subtank 26*c*. The controller 62 controls the pressure difference between the first subtank 26*c* and the second sub tank 26*d*, thus adjusting the circulation flowing amount of ink in such circulation channels 33, 34.

The controller 62 may make the pressure of the second subtank 26*d* higher than the pressure of the first subtank 26*c* so that ink is inhibited from flowing from the second subtank 26*d* to the first subtank 26*c* via the connection channel 26*e*. In this configuration, ink circulates as follows: ink is supplied from the second subtank 26*d* to the return manifold 24, returns from the supply manifold 23 to the first subtank 26*c*, and flows to the second subtank 26*d*. In all the above embodiments, the position of the head chips 20 with respect to the recording medium M is determined by the setting data of the printing data. The present disclosure, however, is not limited thereto. For example, as depicted in FIG. 16, the liquid discharge apparatus 10 may include the medium detecting portion 90 that detects the recording medium M.

The controller 62 specifies the size of the recording medium M based on the detection signal from the medium detecting portion 90. The controller 62 determines the positional relationship between the recording medium M and the head chips 20. Accordingly, the head chips 20 in the discharge head 11*a* are determined as any of the end head chips 20, the facing head chip(s) 20, and the non-facing head chip(s) 20.

In all the above embodiments, the return manifold 24 is included in the channels. The return manifold 24, however, may not be included therein. In this case, the supply manifold 23 has the supply opening 23*a* and the return opening 24*a* at both ends in the conveyance direction, and the individual channels 22 do not include the return-side throttle channels 22*d*.

Thus, ink supplied from the subtank 26 passes through the supply channel 26*a*, and flows into the supply manifold 23 via the supply opening 23*a*. Ink passing through the supply manifold 23 diverges into the individual channels 22. In each individual channel 22, ink flows through the supply-side throttle channel 22*a*, the pressure chamber 22*b*, and the descender 22*c* in this order. Then, ink flows into the nozzle 21. Ink not flowing into the individual channels 22 from the supply manifold 23 is discharged from the supply manifold 23 via the communicating channel 25. Then, ink flows through the return channel 26*b*, returns to the subtank 26, and circulates.

In all the above embodiments, the communicating channel 25 connecting the supply manifold 23 to the return manifold 24 is provided. The communicating channel 25, however, may not be provided. In that case, the liquid discharge apparatus 10 may not include the manifold circulation channel 33.

Each embodiment and each modified embodiment may be combined provided that no contradiction or exclusion is caused. For example, the liquid discharge apparatus 10 according to each of the second to the fourth embodiments may execute any one of the processes of the first to the third modified embodiments. The liquid discharge apparatus 10 according to each of the third and fourth embodiments may execute the process of the second embodiment. The liquid discharge apparatus 10 according to the fourth embodiment may execute the process of the third embodiment.

From the above description, many modifications and other embodiments of the present disclosure are apparent to those skilled in the art. The above description should thus be interpreted as just examples, and is provided to teach those skilled in the art the best mode for carrying out the present disclosure. Details about the configurations and/or the functions described above may be substantially changed without departing from the gist and scope of the present disclosure.

The present disclosure is applicable to a liquid discharge apparatus, a liquid discharge method, and a program that are capable of reducing power consumption and heat generation required for maintenance while inhibiting deterioration in image quality due to drying of ink.

What is claimed is:

1. A liquid discharge apparatus, comprising:

a conveyer configured to convey a recording medium in a conveyance direction;

a plurality of head chips aligned in a width direction orthogonal to the conveyance direction, each of the head chips comprising: a manifold; a nozzle group comprising a plurality of nozzles communicating with the manifold; and a plurality of actuators corresponding to the nozzles, each of the head chips configured to execute discharge drive and non-discharge vibration drive, wherein a liquid is discharged from a nozzle included in the nozzles in the discharge drive and a meniscus of a nozzle included in the nozzles is vibrated without discharging the liquid from the nozzle in the non-discharge vibration drive;

a circulation channel wherein the liquid circulates between the manifolds and a tank containing the liquid through the circulation channel; and a controller;

wherein the head chips include:

an end head chip facing an end of the recording medium in the width direction;

a facing head chip adjacent to a first side of the end head chip in the width direction and facing the recording medium; and a non-facing head chip adjacent to a second side of the end head chip in the width direction and not facing the recording medium, wherein the controller is configured to make at least one of a circulation flowing amount of the liquid in the circulation channel in the facing head chip and a frequency of the non-discharge vibration drive by an actuator included in the actuators in the facing head chip larger than at least one of a circulation flowing amount of the liquid in the circulation channel in the non-facing head chip and a frequency of the non-discharge vibration drive by an actuator included in the actuators in the non-facing head chip, and wherein the controller is configured to make at least one of a circulation flowing amount of the liquid and a frequency of the non-discharge vibration drive in the end head chip larger than in the facing head chip and the non-facing head chip.

2. The liquid discharge apparatus according to claim 1, wherein the nozzle group of the end head chip includes a facing end nozzle facing the recording medium, and a non-facing end nozzle not facing the recording medium, and the controller is configured to make a frequency of the non-discharge vibration drive for the facing end nozzle larger than a frequency of the non-discharge vibration drive for the non-facing end nozzle.

3. The liquid discharge apparatus according to claim 2, wherein the controller is configured to make a circulation flowing amount of the liquid of the facing end nozzle equal to a circulation flowing amount of the liquid of the non-facing end nozzle.

4. The liquid discharge apparatus according to claim 1, wherein the controller is configured to increase the frequency of the non-discharge vibration drive as a discharge duty of the liquid from the nozzle decreases.

5. The liquid discharge apparatus according to claim 1, further comprising a drive circuit configured to drive the actuators, wherein the controller is configured to output, to the drive circuit, dot data which defines a dot to be formed on the recording medium by the liquid to be discharged from the nozzle, and selection data for selecting an operation pattern depending on the frequency of the non-discharge vibration drive from among a plurality for the non-discharge vibration drive of the actuator, wherein the drive circuit is configured to generate drive data for driving the actuator, the actuator is driven by combining discharge drive data depending on the dot data and non-discharge vibration drive data corresponding to the operation pattern selected using the selection data.

6. The liquid discharge apparatus according to claim 5, further comprising a temperature sensor configured to detect a temperature in the liquid discharge apparatus, wherein, in a case that a detected temperature by the temperature sensor is equal to or higher than a first predefined temperature in at least one of the end head chip, the facing head chip, and the non-facing head chip, the controller is configured to select an operation pattern included in the operation patterns, wherein a frequency of the operation pattern is smaller than a case where the detected temperature is less than the first predefined temperature.

7. The liquid discharge apparatus according to claim 6, wherein, in response to the detected temperature by the temperature sensor in at least one of the end head chip, the facing head chip, and the non-facing head chip being less than a second predefined temperature that is lower than the first predefined temperature, the controller is configured to select an operation pattern included in the operation patterns, wherein the frequency of the operation pattern is smaller as the detected temperature is higher.

8. The liquid discharge apparatus according to claim 5, further comprising a humidity sensor configured to detect humidity in the liquid discharge apparatus, wherein in a case that a detected humidity by the humidity sensor is equal to or higher than a first predefined humidity in at least one of the end head chip, the facing head chip, and the non-facing head chip, the controller is configured to select an operation pattern included in the operation patterns, wherein the frequency of the operation pattern is smaller than a case where the detected humidity is less than the first predefined humidity.

9. A liquid discharge apparatus, comprising:

a conveyer configured to convey a recording medium in a conveyance direction;

a plurality of head chips aligned in a width direction orthogonal to the conveyance direction, each of the head chips comprising: a manifold; a nozzle group comprising a plurality of nozzles communicating with the manifold; and a plurality of actuators corresponding to the nozzles, each of the head chips configured to execute discharge drive and non-discharge vibration drive, wherein a liquid is discharged from a nozzle included in the nozzles in the discharge drive and a meniscus of a nozzle included in the nozzles is vibrated without discharging the liquid from the nozzle in the non-discharge vibration drive;

a circulation channel wherein the liquid circulates between the manifold and a tank containing the liquid through the circulation channel; and a controller;

wherein the head chips include:

an end head chip facing an end of the recording medium in the width direction;

a facing head chip adjacent to a first side of the end head chip in the width direction and facing the recording medium; and a non-facing head chip adjacent to a second side of the end head chip in the width direction and not facing the recording medium, wherein the controller is configured to make at least one of a circulation flowing amount of the liquid in the circulation channel in the facing head chip and a frequency of the non-discharge vibration drive by an actuator included in the actuators in the facing head chip larger than at least one of a circulation flowing amount of the liquid in the circulation channel in the non-facing head chip and a frequency of the non-discharge vibration drive by an actuator included in the actuators in the non-facing head chip, wherein the recording medium is a cut sheet, and the controller is configured to make a frequency of the non-discharge vibration drive in a first nozzle smaller than a frequency of the non-discharge vibration drive in a second nozzle, wherein the first nozzle is included in the nozzles and faces a space between a preceding cut sheet and a succeeding cut sheet conveyed next to the preceding cut sheet, the second nozzle is included in the nozzles and faces one of the preceding cut sheet and the succeeding cut sheet.

* * * * *